US006944414B2

(12) United States Patent
Harumoto et al.

(10) Patent No.: US 6,944,414 B2
(45) Date of Patent: Sep. 13, 2005

(54) IMAGE FORMING APPARATUS, A DEVELOPER LEAKAGE PREVENTING MEMBER FOR USING THE SAME AND A METHOD FOR SHIPPING/TRANSPORTING AN IMAGE FORMING APPARATUS

(75) Inventors: Katsumi Harumoto, Saitama (JP); Toyohiko Awano, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 119 days.

(21) Appl. No.: 10/731,443

(22) Filed: Dec. 10, 2003

(65) Prior Publication Data

US 2004/0165908 A1 Aug. 26, 2004

(30) Foreign Application Priority Data

Dec. 11, 2002 (JP) ..... 2002-359861

(51) Int. Cl.[7] ..... G03G 15/08
(52) U.S. Cl. ..... 399/103; 399/106
(58) Field of Search ..... 399/91, 102, 103, 399/106, 110, 119; 222/DIG. 1

(56) References Cited

U.S. PATENT DOCUMENTS 6,484,000 B1 * 11/2002 Ogawa et al. ..... 399/106
6,549,735 B2 * 4/2003 Fujita et al. ..... 399/103
6,813,457 B2 * 11/2004 Yoshiki ..... 399/92

FOREIGN PATENT DOCUMENTS

| | | |
|---|---|---|
| JP | 64-49953 U | 3/1989 |
| JP | 2000-19839 A | 1/2000 |
| JP | 2002-214906 A | 7/2002 |

* cited by examiner

*Primary Examiner*—Hoan Tran
(74) *Attorney, Agent, or Firm*—Morgan, Lewis & Bockius LLP

(57) ABSTRACT

Provided is an image forming apparatus that not only prevents leakage of a developer from a developing apparatus due to vibrations and the like at the time of transportation but also enables attachment of a developer leakage preventing member to a miniaturized image forming apparatus and facilitates attachment and detachment of the developer leakage preventing member at the time of use of the image forming apparatus. The image forming apparatus that is shipped with a developing member being fitted to an apparatus main body includes a developer leakage preventing member that prevents leakage of a developer from the developing member, in which the developer leakage preventing member is fitted at an attachment position opposing the developing member in place of a component that is detachably attachable to the apparatus main body at the attachment position.

28 Claims, 26 Drawing Sheets

(a)

(b)

(a)

(b)

(a)

(b)

(a)

(b)

(a)

(b)

IMAGE FORMING APPARATUS, A DEVELOPER LEAKAGE PREVENTING MEMBER FOR USING THE SAME AND A METHOD FOR SHIPPING/TRANSPORTING AN IMAGE FORMING APPARATUS

FIELD OF THE INVENTION AND RELATED ART STATEMENT

The present invention relates to an image forming apparatus and a developer leakage preventing member for using the same and a method for shipping/transporting an image forming apparatus, such as a copying machine, a printer, a facsimile, or a composite machine integrating their functions, that records an image on a recording medium, such as a recording sheet or a card, using an electrophotographic system. In particular, the present invention relates to an image forming apparatus including an image bearing body, such as a photosensitive drum, and a developing apparatus.

Conventional image forming apparatuses, such as a copying machine, a printer, a facsimile, and a composite machine integrating their functions, that use the electrophotographic system are each constructed so as to operate in the manner described below. First, the surface of a photosensitive drum is uniformly electrified to a predetermined potential. Then, an electrostatic latent image corresponding to image information is formed by performing image exposure on the electrified surface of the photosensitive drum and a toner image is formed by visualizing the electrostatic latent image on the photosensitive drum using a developing apparatus. Finally, the toner image is transferred onto and fixed on a recording sheet, thereby forming an image.

Also, various image forming apparatuses that are each capable of forming a color image using a four-cycle system, a tandem system, or the like are proposed and are already commercially available. Among these apparatuses, the image forming apparatus adopting the four-cycle system sequentially forms electrostatic latent images corresponding to various colors, such as yellow, magenta, cyan, and black, on a photosensitive drum and sequentially develops the electrostatic latent images using corresponding developing devices of a rotary developing apparatus. Toner images in the colors of yellow, magenta, cyan, and black sequentially formed on the photosensitive drum are multiplex-transferred onto an intermediate transfer belt. Then, these toner images on the intermediate transfer belt are collectively transferred onto and fixed on a recording sheet, thereby forming a color image.

On the other hand, the image forming apparatus adopting the tandem system is provided with multiple photosensitive drums corresponding to various colors such as yellow, magenta, cyan, and black. First, toner images are formed on the multiple photosensitive drums and are primarily transferred onto an intermediate transfer body such as an intermediate transfer belt or an intermediate transfer drum. Then, the toner images on the intermediate transfer body are secondarily transferred onto a recording medium by one operation, thereby forming a full-color image or the like.

By the way, after manufacturing at factories, the image forming apparatuses are shipped with developing apparatuses being fitted to apparatus main bodies. By doing so, it becomes possible for users to use the image forming apparatuses immediately after arrival of the apparatuses.

If the image forming apparatuses are shipped under such a state, however, there occurs a problem that leakage of developers from the developing apparatuses occurs due to vibrations, shocks, and the like at the time of transportation and therefore the insides of the apparatus main bodies are soiled.

In view of this problem, various techniques are already proposed, examples of which are disclosed in JP 01-49953 A, JP 2000-19839 A, JP 2002-214906 A, and the like.

For instance, JP 01-49953 A discloses a developing apparatus for a copying machine, where a main body of the developing apparatus includes a developer vessel and a replenishing vessel for replenishing a developer to the developer vessel, the replenishing vessel is divided by a partition wall into a toner replenishing chamber storing a toner and a developer replenishing chamber storing the developer, a toner replenishing opening and a developer replenishing opening are respectively established in the toner replenishing chamber and the developer replenishing chamber on a developer vessel side, and a sealing member for preventing leakage of the developer at the time of transportation of the developing apparatus main body is peelably provided for each of the toner replenishing opening and the developer replenishing opening.

Also, JP 2000-19839 A discloses a rotary developing apparatus that includes multiple developing devices storing developers, which each contain at least a toner and a carrier, and supply the developers to developing rolls, developer cartridges that are detachably attachable to the developing devices and replenish the developing devices with the developers, and a rotation body that makes rotation while holding the developing devices. When the rotation body is rotated, the developing rolls are sequentially set so as to oppose a photosensitive drum, thereby forming a multi-color image. In the rotary developing apparatus, a detachably attachable blocking member is provided which blocks opening portions of the developing devices through which the developing rolls are exposed.

Further, JP 2002-214906 A discloses a developing apparatus including a moving member that is moved at the time of image formation, a seal member that seals a developer by pressing the moving member, and a pressing force switching member for switching a pressing force exerted on the moving member by the seal member.

As described above, with the technique disclosed in JP 01-49953 A, the sealing member for preventing the leakage of the developer at the time of transportation of the developing apparatus main body is peelably provided for each of the toner replenishing opening and the developer replenishing opening. Also, with the technique disclosed in JP 2000-19839 A, the detachably attachable blocking member is provided which blocks the opening portions of the developing devices through which the developing rolls are exposed. Further, with the technique disclosed in JP 2002-214906 A, the seal member that seals the developer by pressing the moving member, such as a developing roller, and the pressing switching member that switches the pressing force exerted on the moving member by the seal member are provided. With these constructions, it becomes possible to prevent leakage of a developer from a developing apparatus due to vibrations and the like at the time of transportation. However, recent image forming apparatuses are small in size, so that there occurs a problem that it is impossible to secure an attachment space for such a member that prevents leakage of a developer in addition to attachment spaces for members already fitted to an apparatus main body. Also, at the time of use of an image forming apparatus, it is required to detach the sealing member, the blocking member, or the seal member, which leads to another problem that users are required to conduct cumbersome work before using the image forming apparatus.

In particular, the latter problem becomes serious and workability is impaired in the case of an image forming apparatus including multiple developing apparatuses corresponding to various colors of yellow, magenta, cyan, and black because it is required to repeatedly perform the detachment of the sealing member, the blocking member, or the seal member by a number of times corresponding to the number of the developing apparatuses.

OBJECT AND SUMMARY OF INVENTION

The present invention has been made in order to solve the problems of the conventional techniques described above, and provides an image forming apparatus and a developer leakage preventing member for using the same and a method for shipping/transporting an image forming apparatus that not only prevents leakage of a developer from a developing apparatus due to vibrations and the like at the time of transportation but also enables attachment of a developer leakage preventing member to a miniaturized image forming apparatus and facilitates attachment and detachment of the developer leakage preventing member at the time of use of the image forming apparatus.

To achieve the above-mentioned object, there is provided an image forming apparatus that is shipped with a developing member being fitted to an apparatus main body, including: a developer leakage preventing member that prevents leakage of a developer from the developing member, in which the developer leakage preventing member is fitted at an attachment position opposing the developing member in place of a component that is detachably attachable to the apparatus main body at the attachment position.

With this construction, it becomes possible to easily secure an attachment space for the developer leakage preventing member even in the case of a miniaturized image forming apparatus. In addition, it becomes possible to extremely easily detach the leakage preventing member.

Further, to solve the above-mentioned problem, according to the present invention, there is provided an image forming apparatus in which: the detachably attachable component is a regularly-replaced component; the regularly-replaced component is an image forming unit including an image bearing body; and the apparatus main body is provided with a positioning portion for the image bearing body and the developer leakage preventing member is provided with a positioning protrusion that is fitted to the positioning portion.

Further, to solve the above-mentioned problem, according to the present invention, there is provided an image forming apparatus in which: the developer leakage preventing member is provided with a seal member in an area opposing the developing member; and with the developer leakage preventing member being fitted to the apparatus main body, the seal member is not abutted against a developing roll of the developing member but is abutted against a housing of the developing member.

Further, to solve the above-mentioned problem, according to the present invention, there is provided an image forming apparatus in which: the developing member is provided with a guide rail that guides the developer leakage preventing member; and the developer leakage preventing member is guided by the guide rail at a time of fitting, and the seal member is abutted against the housing of the developing member at a position at which the fitting is completed.

Further, to solve the above-mentioned problem, according to the present invention, there is provided an image forming apparatus in which in order to set the image forming apparatus inoperable with the developer leakage preventing member being fitted to the apparatus main body, a storage medium is used which is provided for an image forming unit and stores identification information with reference to which the image forming unit is identified on an apparatus main body side.

Further, to solve the above-mentioned problem, according to the present invention, there is provided an image forming apparatus in which in order to set the image forming apparatus inoperable with the developer leakage preventing member being fitted to the apparatus main body, an operation prohibition displaying tag is used which is provided for the developer leakage preventing member and is exhibited outside the apparatus main body.

Further, to solve the above-mentioned problem, according to the present invention, there is provided an image forming apparatus that is shipped with a developing member being fitted to an apparatus main body, including: a developer leakage preventing member that prevents leakage of a developer from the developing member, wherein the developer leakage preventing member is fitted to the apparatus main body in place of an image bearing body opposing the developing member and is fixed to the apparatus main body using a member that is also used to fix the image bearing body thereto.

Further, to solve the above-mentioned problem, according to the present invention, there is provided a developer leakage preventing member that is fitted to an image forming apparatus shipped with a developing member being attached to an apparatus main body so as to oppose an intermediate transfer body, and which prevents leakage of a developer from the developing member, the developer leakage preventing member including :a first surface having a shape with which an opening portion of the developing member is closed; and a second surface having a shape that approximately resembles a part of a shape of the intermediate transfer body.

Further, to solve the above-mentioned problem, according to the present invention, there is provided a method for shipping/transporting an image forming apparatus with a developing member being fitted to an apparatus main body, including :at the time of shipment, retracting a unit including the developing member to a rearward and fitting a developer leakage preventing member in place of an image bearing body unit opposing the developing member; and after transportation, detaching the developer leakage preventing member and fitting the image bearing body unit.

According to the present invention, an intermediate transfer body is any of an intermediate transfer drum, an intermediate transfer belt, and a transport and transfer belt.

As described above, the present invention can provide an image forming apparatus and a developer leakage preventing member for using the same and a method for shipping/transporting an image forming apparatus that not only prevents leakage of a developer from a developing apparatus due to vibrations and the like at the time of transportation but also enables attachment of a developer leakage preventing member to a miniaturized image forming apparatus and facilitates attachment and detachment of the developer leakage preventing member at the time of use of the image forming apparatus.

BRIEF DESCRIPTION OF THE DRAWINGS

Preferred embodiment of the present invention will be described in detail based on the following figures, wherein.

DETAILED DESCRIPTION OF THE PREFERRED EMBODIMENT

Preferred embodiments of the present invention will now be described with reference to the accompanying drawings.

First Embodiment

Figure 2:
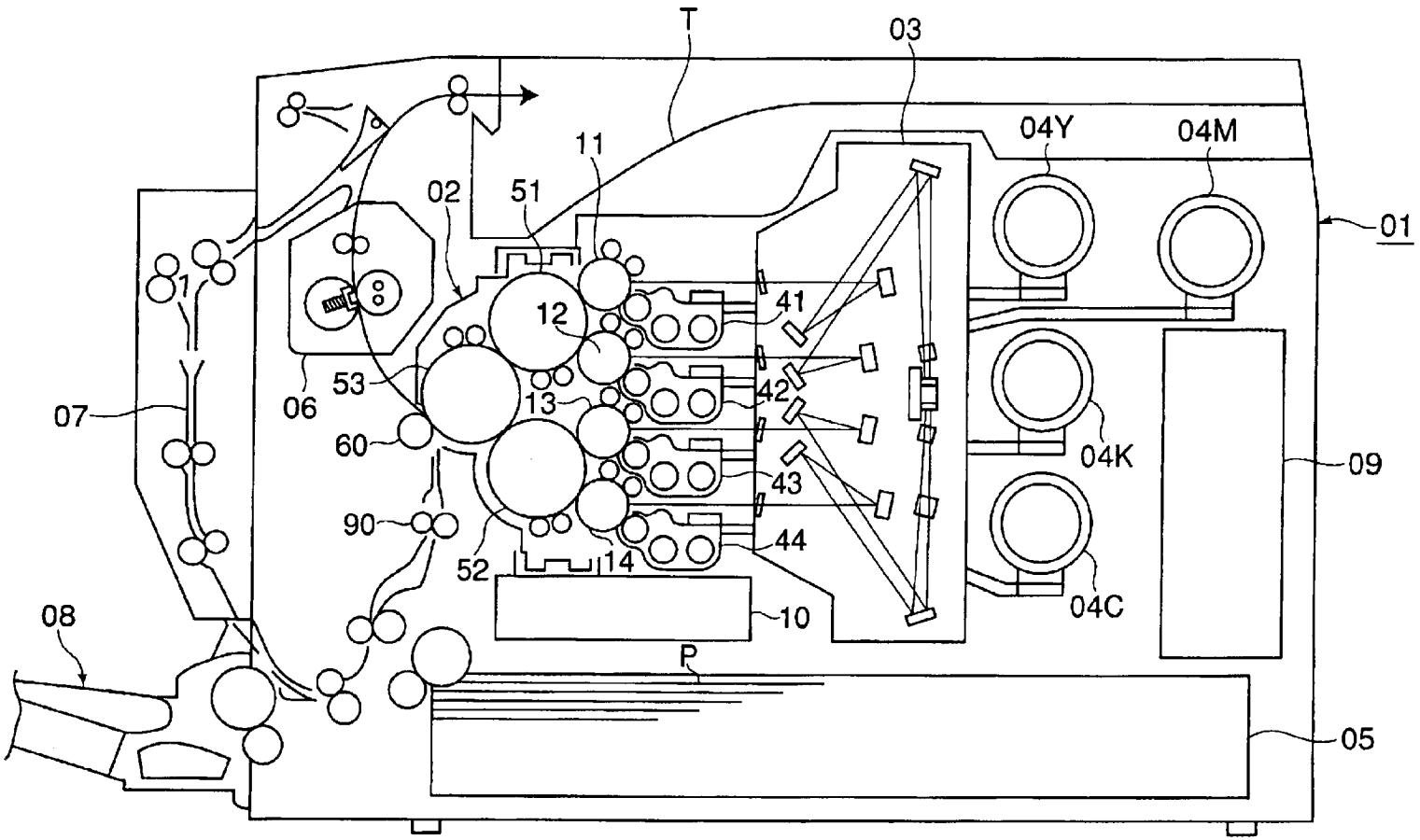
FIG. 2 is a construction diagram showing a tandem-type full-color printer that is the image forming apparatus according to the first embodiment of the present invention.

FIG. 2 shows a tandem-type full-color printer that is an image forming apparatus according to a first embodiment of the present invention.

In FIG. 2, reference numeral 01 denotes a main body of the tandem-type full-color printer. The printer main body 01 mainly includes a print head device 02 that performs full-color image formation, a raster output scanner (ROS) 03 serving as an exposing apparatus that performs image exposure on four photosensitive drums 11, 12, 13, and 14 that each serve as an electrostatic latent image bearing body of the print head device 02, four toner boxes 04Y, 04M, 04K, and 04C that each supply a toner to corresponding one of the developing apparatuses 41, 42, 43, and 44 of the print head device 02, a sheet feeding cassette 05 that feeds a recording sheet P serving as a recording medium to the print head device 02, a fixing apparatus 06 that performs fixing processing on the recording sheet P on which a toner image has been transferred from the print head device 02, a duplex transport path 07 for transporting the recording sheet P, on one surface of which the image has been fixed by the fixing apparatus 06, to a transfer portion of the print head device 02 again with the front surface and the rear surface of the sheet P being reversed, a manual sheet feeding member 08 used to feed a desired recording sheet P from the outside of the printer main body 01, a controller 09 including various circuits such as a control circuit for controlling an operation of the printer and an image processing circuit for performing image processing on an image signal, and an electric circuit 10 including a high-voltage power supply circuit and the like. Note that in FIG. 2, reference symbol T denotes a discharge tray which is arranged integrally with an upper portion of the printer main body 01 and on which the recording sheet P having been subjected to the image formation is discharged.

Among these members disposed in the printer main body 01, the ROS 03 serving as an exposing apparatus includes four semiconductor lasers that are driven to emit laser beams based on image data corresponding to respective colors of yellow (Y), magenta (M), black (K), and cyan (C). The ROS 03 also includes an f-θ lens, a polygon mirror, or multiple reflection mirrors for deflecting and scanning the laser beams emitted from the four semiconductor lasers, and the like.

Figure 3:
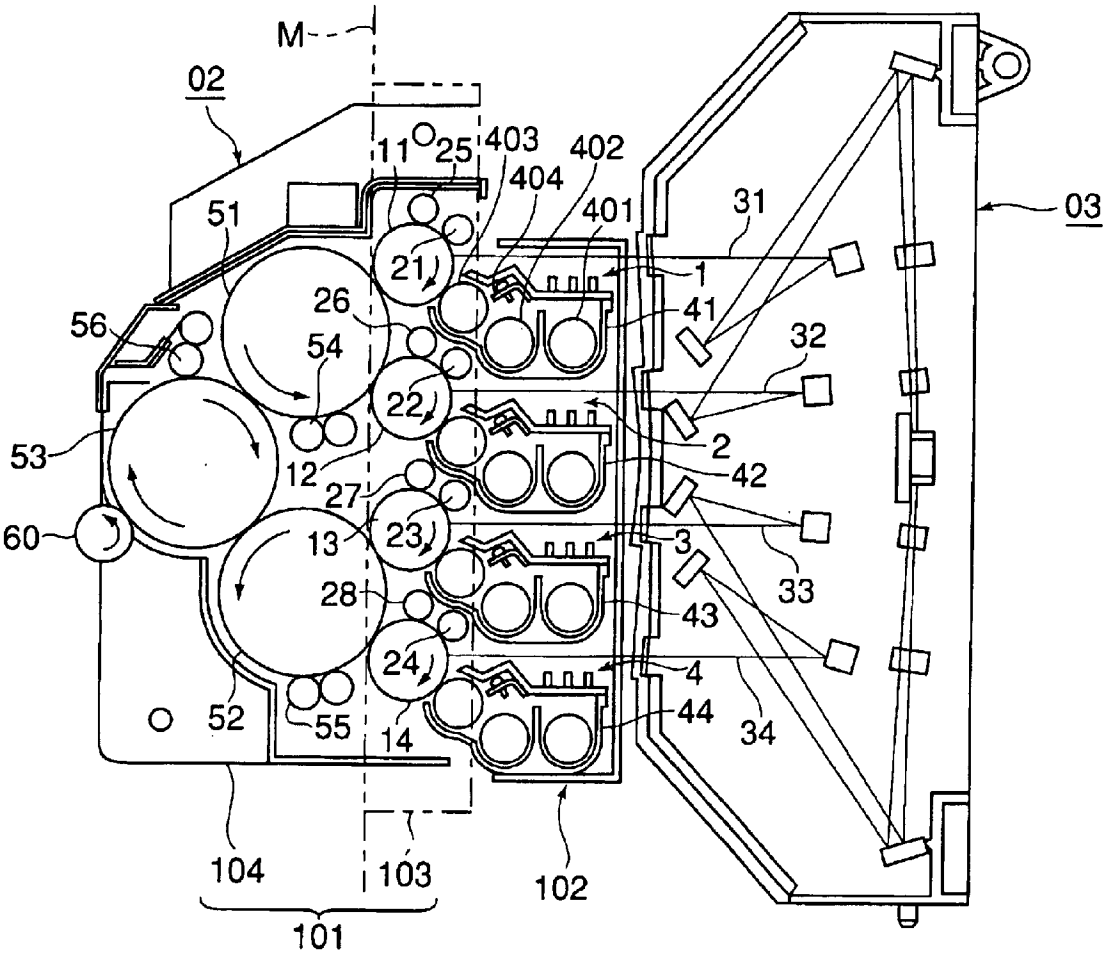
FIG. 3 is a construction diagram showing a print head device of the tandem-type full-color printer that is the image forming apparatus according to the first embodiment of the present invention.

FIG. 3 shows the print head device of the tandem-type full-color printer that is the image forming apparatus according to the first embodiment of the present invention. Note that the arrows in FIG. 3 indicate the rotation directions of the rotation members.

As shown in FIG. 3, the print head device 02 is broadly divided into: image forming portions 1, 2, 3, and 4 that respectively include photosensitive drums (electrostatic latent image bearing bodies) 11, 12, 13, and 14 for respective colors of yellow (Y), magenta (M), black (K), and cyan (C); electrifying rolls (contact-type electrifying apparatuses) 21, 22, 23, and 24 for primary electrification that respectively contact the photosensitive drums 11, 12, 13, and 14; refresher rolls 25, 26, 27, and 28 for temporarily removing toners residing on the surfaces of the photosensitive drums 11, 12, 13, and 14; developing apparatuses 41, 42, 43, and 44 that develop electrostatic latent images, which have been formed on the photosensitive drums 11, 12, 13, and 14 by the laser beams 31, 32, 33, and 34 emitted from the ROS (exposing apparatus) 03, using toners in the respective colors of yellow (Y), magenta (M), black (K), and cyan (C); a first primary intermediate transfer drum (intermediate transfer body) 51 that contacts two photosensitive drums 11 and 12 among the four photosensitive drums 11, 12, 13, and 14; a second primary intermediate transfer drum (intermediate transfer body) 52 that contacts the remaining two photosensitive drums 13 and 14; a secondary intermediate transfer drum (intermediate transfer body) 53 that contacts the first and second primary intermediate transfer drums 51 and 52; and a final transfer roll (transfer member) 60 that contacts the secondary intermediate transfer drum 53. Also, on the surfaces of the intermediate transfer drums 51, 52, and 53, there are disposed cleaning rolls 54, 55, and 56 of a cleaning apparatus that removes toners residing on the surfaces of the intermediate transfer drums 51, 52, and 53.

The photosensitive drums 11, 12, 13, and 14 are aligned parallel to each other at constant intervals so as to have a common tangent plane M. Also, the first primary intermediate transfer drum 51 and the second primary intermediate transfer drum 52 are arranged so that their rotation axes are parallel to the axes of the photosensitive drums 11, 12, 13, and 14 and have a relationship of plane symmetry with respect to a predetermined symmetry plane. Further, the secondary intermediate transfer drum 53 is arranged so that its rotation axis is parallel to the photosensitive drums 11, 12, 13, and 14.

Signals corresponding to image information for the respective colors are rasterized by the image processing circuit disposed on the electric circuit 10 (see FIG. 2) and are inputted into the ROS 03. Then, the ROS 03 modulates the laser beams 31, 32, 33, and 34 for the respective colors of yellow (Y), magenta (M), black (K), and cyan (C) and emits the modulated laser beams onto the photosensitive drums 11, 12, 13, and 14.

Around each of the photosensitive drums 11, 12, 13, and 14, an image forming process for a corresponding color is performed with a known electrophotographic system. In this embodiment, the photosensitive drums 11, 12, 13, and 14 are each an OPC photosensitive drum having a diameter of 30 mm and are rotationally driven at a rotation speed (peripheral speed) of 104 mm/sec. Also, as shown in FIG. 3, the surfaces of the photosensitive drums 11, 12, 13, and 14 are electrified to around −300 V through application of a DC voltage of around −840 V to the electrifying rolls 21, 22, 23, and 24 that each serve as a contact-type electrifying apparatus. Here, any of electrifying apparatuses of a roll type, a film type, a brush type, and the like may be used, although an electrifying roll generally used in recent electrophotographic apparatuses is adopted in this embodiment. Also, in this embodiment, the surfaces of the photosensitive drums 11, 12, 13, and 14 are electrified using an electrifying system that applies only DC, although an electrifying system that applies AC and DC may be used.

After the electrification described above, the surfaces of the photosensitive drums 11, 12, 13, and 14 are irradiated with the laser beams 31, 32, 33, and 34 for the respective colors of yellow (Y), magenta (M), black (K), and cyan (C) emitted from the ROS 03 serving as an exposing apparatus. As a result, electrostatic latent images corresponding to the input image information for the respective colors are formed on the surfaces of the photosensitive drums 11, 12, 13, and 14. Here, as a result of the writing of the electrostatic latent images by the ROS 03, the surface potentials of image exposure portions of the photosensitive drums 11, 12, 13, and 14 are diselectrified to around −60 V or less.

Then, the electrostatic latent images for the respective colors of yellow (Y), magenta (M), black (K), and cyan (C) formed on the surfaces of the photosensitive drums 11, 12, 13, and 14 are each developed by corresponding one of the developing apparatuses 41, 42, 43, and 44. By doing so, the electrostatic latent images for the respective colors are visualized as toner images in the respective colors of yellow (Y), magenta (M), black (K), and cyan (C) on the photosensitive drums 11, 12, 13, and 14.

In this embodiment, the developing apparatuses 41, 42, 43, and 44 are each a two-component development system of a magnetic brush contact type, although the present invention is not limited to this development system. That is, it is of course possible to apply the present invention to a development system of a non-contact type without any problems.

The developing apparatuses 41, 42, 43, and 44 are each filled with a developer containing a toner in one of the colors of yellow (Y), magenta (M), black (K), and cyan (C) and a carrier. As shown in FIG. 2, these developing apparatuses 41, 42, 43, and 44 are each replenished with the toner by corresponding one of the toner boxes 04Y, 04M, 04K, and 04C. Then, the replenished toner is triboelectrified through sufficient agitation with the carrier by augers 401 and 402. In each developing roll 403, a magnet roll (not shown) having multiple magnetic poles arranged at predetermined angles is fixedly disposed. The developer supplied to the vicinity of the surface of the developing roll 403 by the auger 402 supplying the developer to the developing roll 403 is regulated in amount by a developer amount regulating member 404 and is supplied to the developing portion. In this embodiment, the amount of the developer on the developing roll 403 is regulated to 30 to 50 g/m$^2$. Also, the electrification amount of the toner existing on the developing roll 403 at this time is set at approximately around −20 to 35 $\mu$C/g.

The toner supplied onto each developing roll 403 is shaped as a magnetic brush including the carrier and the toner by the magnetic force of the magnet roll. This magnetic brush contacts corresponding one of the photosensitive drums 11, 12, 13, and 14, so that when an AC and DC developing bias voltage is applied to the developing roll 403, the electrostatic latent image formed on each photosensitive drum are developed by the toner on the developing roll 403. By doing so, toner images are formed. In this embodiment, for instance, the AC component of the developing bias voltage is set at 4 kHz and 1.5 kVpp and the DC component thereof is set at around −230 V.

In this embodiment, so-called "spherical toners" (toners having an approximately spherical shape) with an average particle diameter of around 3 to 10 $\mu$m are used in the developing apparatuses 41, 42, 43, and 44. Here, for instance, the average particle diameter of a black toner is set at 8 $\mu$m and the average particle diameter of color toners is set at 7 $\mu$m.

Next, the toner images in the respective colors of yellow (Y), magenta (M), black (K), and cyan (C) formed on the photosensitive drums 11, 12, 13, and 14 are electrostatically and primarily transferred onto the first primary intermediate transfer drum 51 and the second primary intermediate transfer drum 52. The toner images in yellow (Y) and magenta (M) formed on the photosensitive drums 11 and 12 are transferred onto the first primary intermediate transfer drum 51, while the toner images in black (K) and cyan (C) formed on the photosensitive drums 13 and 14 are transferred onto the second primary intermediate transfer drum 52. Accordingly, a one-color image transferred from one of the photosensitive drum 11 and the photosensitive drum 12 or a two-color image, in which the toner images in two colors respectively transferred from the photosensitive drum 11 and the photosensitive drum 12 are superimposed on each other, is formed on the first primary intermediate transfer drum 51. In a like manner, a one-color image from the photosensitive drum 13 or 14 or a two-color image from the photosensitive drums 13 and 14 is formed on the second primary intermediate transfer drum 52.

The surface potentials of the first and second primary intermediate transfer drums 51 and 52 required to electrostatically transfer the toner images from the photosensitive drums 11, 12, 13, and 14 onto the first and second primary intermediate transfer drums 51 and 52 is around +250 to 500 V. The surface potentials are each set at an optimum value in accordance with the electrification state of the toner, the atmospheric temperature, and the humidity. The atmospheric temperature and the humidity can be easily known by detecting the resistance value of a member having characteristics where a resistance value varies in accordance with the atmospheric temperature and the humidity. As described above, the electrification amount of the toner is in the range of −20 to 35 $\mu$C/g, so that it is desirable that the surface potentials of the first and second primary intermediate transfer drums 51 and 52 are each around +380 V under normal temperature and humidity circumstances.

The first and second primary intermediate transfer drums 51 and 52 used in this embodiment are formed so as to have an outside diameter of 60 mm and a resistance value of around $10^8\Omega$, for instance. Also, the first and second primary intermediate transfer drums 51 and 52 are each a cylindrical rotation body including a single layer or multiple layers and having a surface with flexibility or elasticity. Generally, a low-resistance elastic rubber layer ($R=10^2$ to $10^3\Omega$) typified by a layer made of conductive silicon rubber or the like is provided so as to have a thickness of around 0.1 to 10 mm on a metal pipe serving as a metal core made of Fe, Al, or the like. Then, typically, the outermost surfaces of the first and second intermediate transfer drums 51 and 52 are each formed by producing a high-releasable layer ($R=10^5$ to $10^9\Omega$) with a thickness of 3 to 100 $\mu$m using fluororubber, in which fluororesin fine particles are dispersed, and bonding this layer using a silane coupling agent-based adhesive (primer). Here, the important factors are the resistance value and the surface releasability. Therefore, the material of the high-releasable layer is not specifically limited and it is possible to use any material so long as the material achieves high releasability and a resistance value of around $R=10^5$ to $10^9\Omega$.

The one-color or the two-color toner image formed on each of the first and second primary intermediate transfer drums 51 and 52 in this manner is electrostatically and secondary transferred onto the secondary intermediate transfer drum 53. As a result, a final toner image ranging from a one-color image to a four-color image in yellow (Y), magenta (M), cyan (C), and black (K) is formed on the secondary intermediate transfer drum 53.

The surface potential of the secondary intermediate transfer drum 53 required to electrostatically transfer the toner images from the first and second primary intermediate transfer drums 51 and 52 onto the secondary intermediate transfer drum 53 is around +600 to 1200 V. This surface potential is set at an optimum value in accordance with the electrification state of the toner, the atmospheric temperature, and the humidity, like in the case of the transfer from the photosensitive drums 11, 12, 13, and 14 onto the first primary intermediate transfer drum 51 and the second primary intermediate transfer drum 52. Also, a potential difference between the first and second primary intermediate transfer drums 51 and 52 and the secondary intermediate transfer drum 53 is required to perform the secondary transfer, so that it is required to set the surface potential of the secondary intermediate transfer drum 53 at a value corresponding to the surface potentials of the first and second primary intermediate transfer drums 51 and 52. As described above, the electrification amount of the toner is in the range of −20 to 35 $\mu$C/g. Therefore, when the surface potentials of the first and second primary intermediate transfer drums 51 and 52 are around +380 V under the normal temperature and humidity circumstances, it is desirable that the surface potential of the secondary intermediate transfer drum 53 is set at around +880 V. As a result, it is desirable that the potential difference between the first and second primary intermediate transfer drums 51 and 52 and the secondary intermediate transfer drum 53 is set at around +500 V.

The secondary intermediate transfer drum 53 used in this embodiment is formed so as to have an outside diameter of 60 mm, which is the same as the outside diameters of the first and second primary intermediate transfer drums 51 and 52, and have a resistance value of around $10^{11}\Omega$, for instance. Also,like the first and second primary intermediate transfer drums 51 and 52, the secondary intermediate transfer drum 53 is a cylindrical rotation body including a single layer or multiple layers and having a surface with flexibility or elasticity. Generally, a low-resistance elastic rubber layer ($R=10^2$ to $10^3\Omega$) typified by a layer made of conductive silicon rubber or the like is provided so as to have a thickness of around 0.1 to 10 mm on a metal pipe serving as a metal core made of Fe, Al, or the like. Then, typically, the outermost surface of the secondary intermediate transfer drum 53 is formed by producing a high-releasable layer with a thickness of 3 to 100 $\mu$m using fluororubber, in which fluororesin fine particles are dispersed, and bonding this layer using a silane coupling agent-based adhesive (primer). Here, it is required to set the resistance value of the secondary intermediate transfer drum 53 higher than those of the first and second primary intermediate transfer drums 51 and 52. This is because if not so, the secondary intermediate transfer drum 53 would electrify the first and second primary intermediate transfer drums 51 and 52 and therefore it becomes difficult to control the surface potentials of the first and second primary intermediate transfer drums 51 and 52. The material of the secondary intermediate transfer drum 53 is not specifically limited and it is possible to use any material so long as the material satisfies such conditions.

Next, the final toner image ranging from the one-color image to the four-color image formed on the secondary intermediate transfer drum 53 is tertiarily transferred by the final transfer roll 60 onto a sheet P passing through a sheet transport path. After a not-shown sheet feeding step, the sheet P passes through between sheet transport rolls 90 and is sent into a nip portion between the secondary intermediate transfer drum 53 and the final transfer roll 60. After this final transfer step, the final toner image formed on the sheet is fixed by the fixing apparatus 06 and a series of image forming processes are completed.

The process cartridge of the image forming apparatus according to this embodiment that includes at least the multiple electrostatic latent image bearing bodies and the intermediate transfer bodies is detachably attachable to a predetermined position of the apparatus main body. Also, supporting axes of the multiple electrostatic latent image bearing bodies and the intermediate transfer bodies are attached to the process cartridge under a temporary positioning state. When the process cartridge is fitted to the predetermined position of the apparatus main body, the supporting axes of the multiple electrostatic latent image bearing bodies and intermediate transfer bodies are positioned at their regular positions by a first positioning member provided for the apparatus main body.

Also, in this embodiment, the process cartridge includes a first unit having the multiple electrostatic latent image bearing bodies and the electrification apparatuses for electrifying the surfaces of the electrostatic latent image bearing bodies and a second unit having at least the multiple intermediate transfer bodies and the cleaning apparatus for cleaning the surfaces of the intermediate transfer bodies.

Further, in this embodiment, the first unit and the second unit of the process cartridge are each provided with an engaging member with which at least one of the units is engaged with the other thereof. With this construction, the first and second units are engaged with each other through the engaging members and are integrally attached to and detached from the apparatus main body under the engagement state.

It should be noted here that the first and second units may be detachably attachable to the apparatus main body independently of each other.

In this embodiment, as shown in FIG. 3, the print head device 02 is broadly divided into a process cartridge 101 and a developing apparatus unit 102. Also, the process cartridge 101 is divided into a photosensitive unit 103 (or the first unit) having the four photosensitive drums 11, 12, 13, and 14, the contact-type electrification apparatuses 21, 22, 23, and 24, and the refreshers 25, 26, 27, and 28, and an intermediate transfer unit 104 (or the second unit) having the three intermediate transfer drums 51, 52, and 53 and the cleaning rolls 54, 55, and 56. Here, the process cartridge 101 is detachably attachable to the printer main body 01 and, at the time of detachment from the printer main body 01, the process cartridge 101 is pulled out toward the frontward side.

Figure 4:
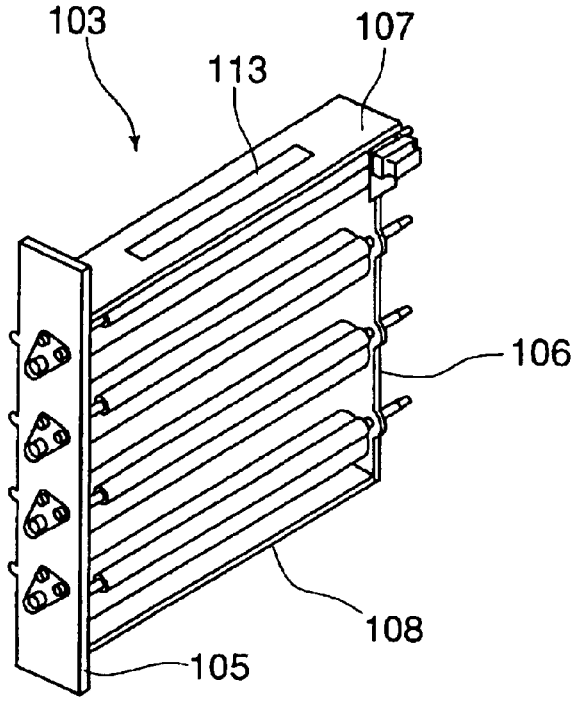
FIG. 4 is an external perspective view showing a photosensitive unit.
Figure 5:
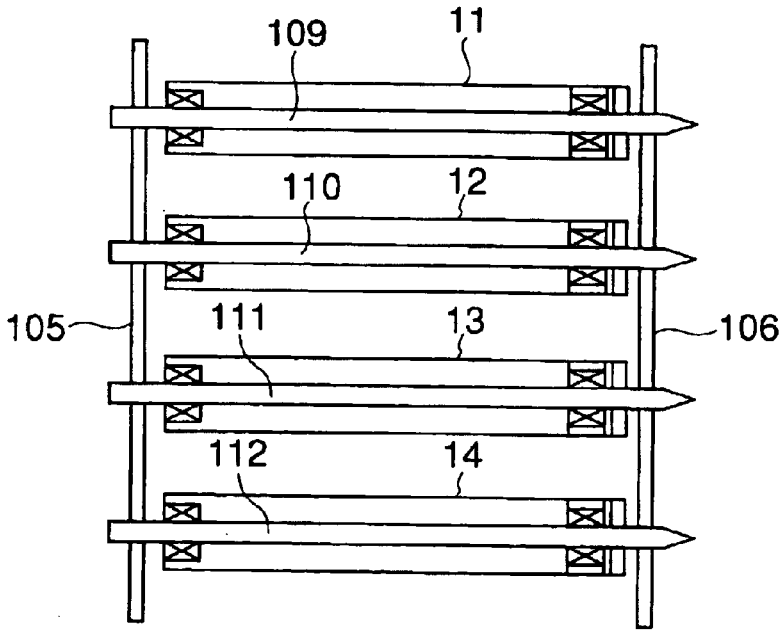
FIG. 5 is a cross-sectional view showing the photosensitive unit.

In addition, as shown in FIG. 3, in the photosensitive unit 103, the four photosensitive drums 11, 12, 13, and 14 a realigned parallel to each other at constant intervals. Also, the contact-type electrification apparatuses 21, 22, 23, and 24 and the temporary cleaning members 25, 26, 27, and 28 called "refresher" are attached so as to be respectively abutted against the surfaces of the photosensitive drum 11, 12, 13, and 14. As shown in FIG. 4, this photosensitive unit 103 is a frame body having rectangular side surfaces where a front-side panel 105 made of a rectangular sheet metal has a rectangular shape that is long in a vertical direction, a rear-side panel 106 made of a sheet metal has a rectangular shape that is long in the vertical direction and is somewhat shorter than the front-side panel 105, and an upper-side panel 107 and a lower-side panel 108 connect the front-side panel 105 and the rear-side panel 106 to each other. Also, as shown in FIG. 5, in the photosensitive unit 103, supporting axes 109, 110, 111, and 112 rotationally supporting the four photosensitive drums 11, 12, 13, and 14 are aligned parallel to each other at constant intervals under a temporary positioning state. These four supporting axes 109, 110, 111, and 112 are supported by holes established in supporting portions of the front-side panel 105 and the rear-side panel 106 and being some what larger than the diameters of the supporting axes 109, 110, 111, and 112. Also, the supporting axes 109, 110, 111, and 112 are attached to the front-side panel 105 and the rear-side panel 106 under a temporary positioning state so as to be movable with slight play. Note that in this embodiment, the four supporting axes 109, 110, 111, and 112 are supported by the holes that are some what larger than the diameters of the supporting axes 109, 110, 111, and 112, although these supporting axes may be attached under the temporary positioning state using temporary positioning members made of an elastic body such as rubber. The lengths of the four supporting axes 109, 110, 111 are set so that the front-end portions of these supporting axes slightly protrude from the front-side panel 105 and the rear-end portions of the supporting axes significantly protrude from the rear-side panel 106. Also, the tips of the rear-end portions of the supporting axes 109, 110, 111, and 112 are formed in a tapered shape. Note that in FIG. 4, reference numeral 113 denotes a holding belt that is used to hold the photosensitive unit 103.

Figure 6:
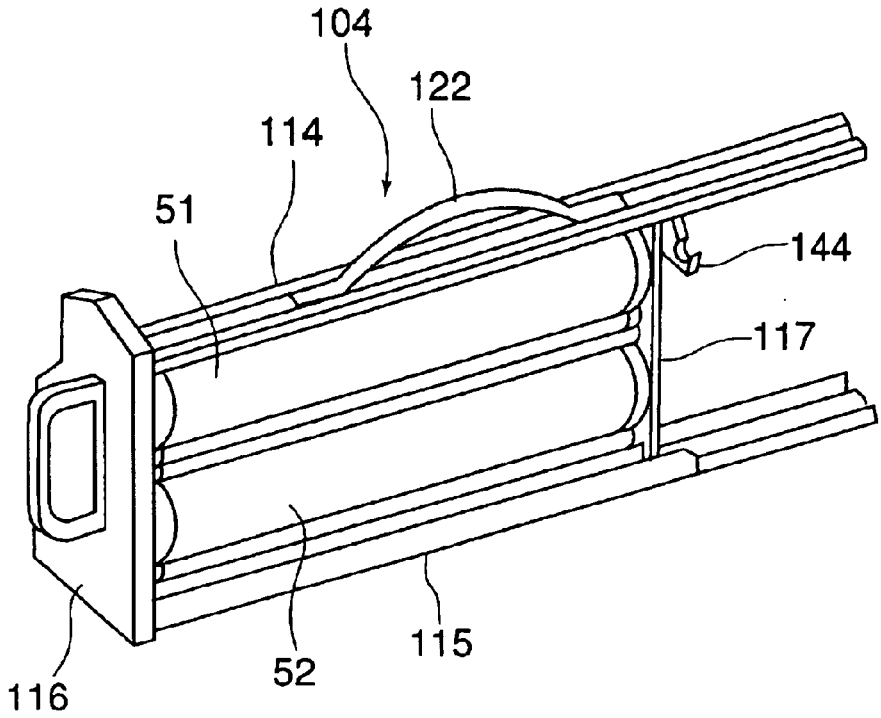
FIG. 6 is an external perspective view showing an intermediate transfer unit.

On the other hand, as shown in FIG. 3, in the intermediate transfer unit 104, the three intermediate transfer drums 51, 52, and 53 are arranged parallel to each other at constant intervals so as to form a triangular shape. Also, the cleaning members 54, 55, and 56 called "refresher" are attached so as to be respectively abutted against the surfaces of the intermediate transfer drums 51, 52, and 53. As shown in FIG. 6, this intermediate transfer unit 104 is a large frame body where an upper-side and lower-side side panels 114 and 115 made of a sheet metal are disposed parallel to each other on an upper side and a bottom side, and front-side and rear-side panels 116 and 117 made of a sheet metal and having a reverse-D-letter-shaped front surface are disposed so as to connect the upper-side and lower-side side panels 114 and 115 to each other. The upper-side and lower-side side panels 114 and 115 also serve as guide rails that engage with guide rails provided on the printer main body 01 side. With this construction, as shown in FIGS. 8 and 9, the intermediate transfer unit 104 is detachably attachable to the printer main body 01 together with the photosensitive unit 103.

Figure 8:
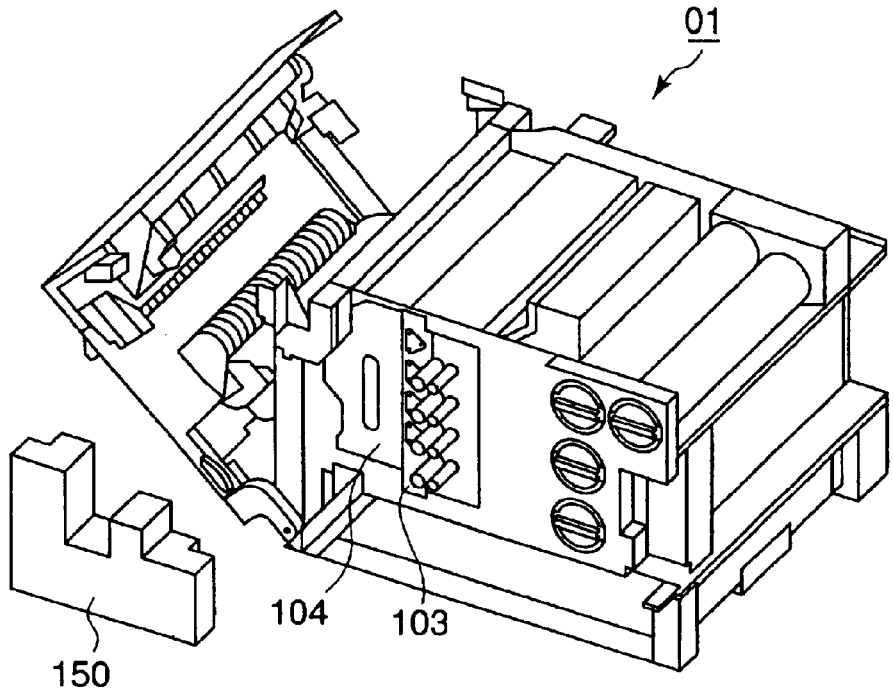
FIG. 8 is an external perspective view showing the photosensitive unit and the intermediate transfer unit under a state of being attached.
Figure 9:
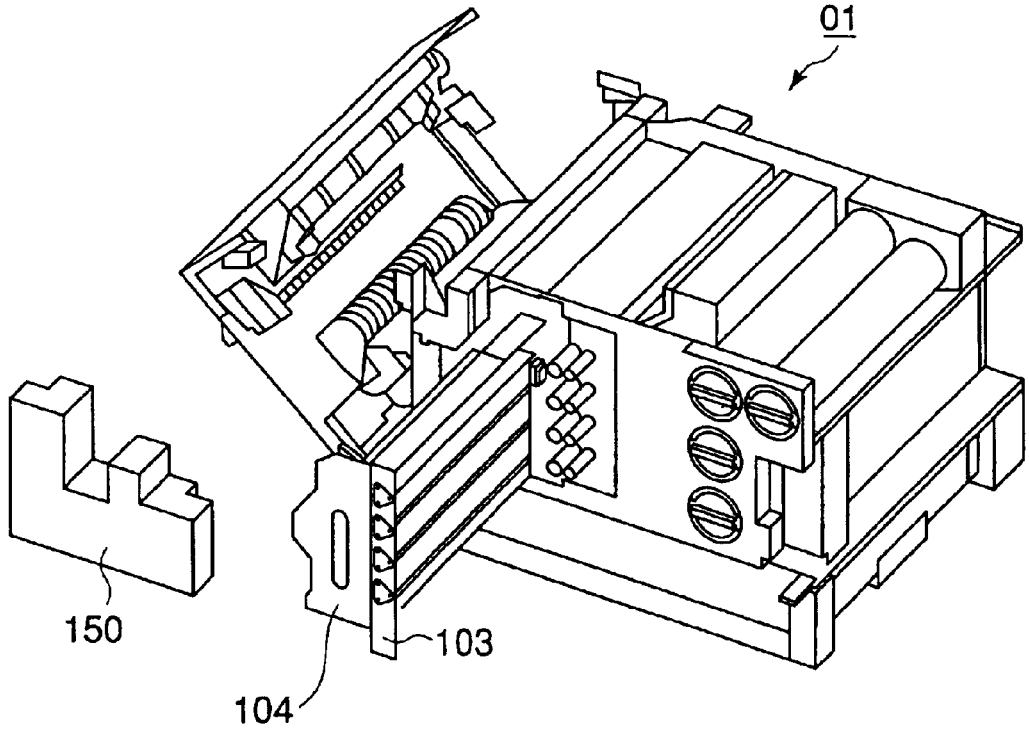
FIG. 9 is an external perspective view showing the photosensitive unit and the intermediate transfer unit under a state of being detached.

It should be noted here that in FIGS. 8 and 9, reference numeral 150 denotes an exhausted toner box in which toners exhausted from the developing apparatuses 41, 42, 43, and 44 and the cleaning apparatus 80 are stored.

Figure 10:
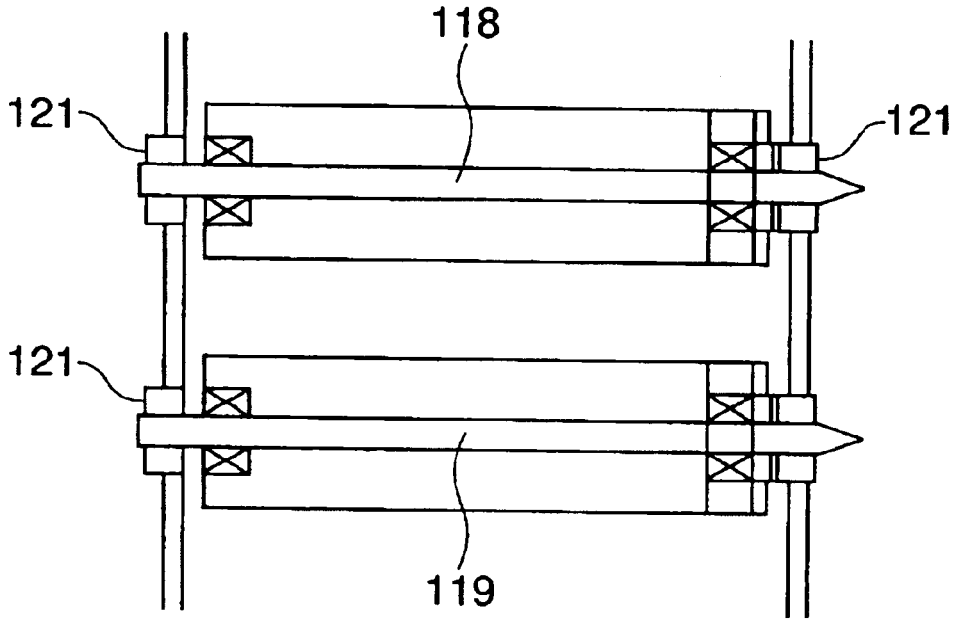
FIG. 10 is a cross-sectional view of the intermediate transfer unit.

As shown in FIG. 10, in the intermediate transfer unit 104, supporting axes 118, 119, and 120 (supporting axis 120 is omitted in FIG. 10) rotationally supporting the three intermediate transfer drums 51, 52, and 53 are aligned parallel to each other at constant intervals under a temporary positioning state. Note that in the illustrated embodiment, among the three supporting axes 118, 119, and 120, the supporting axis 120 that rotationally supports the intermediate transfer drum 53 is positioned at a predetermined regular position of the intermediate transfer unit 104. With this supporting axis 120, the intermediate transfer unit 104 is positioned at a predetermined position of the printer main body 01. Also, in FIG. 10, among the three supporting axes 118, 119, and 120, two supporting axes 118 and 119 are attached under a temporary positioning state using temporary positioning members 121 made of an elastic body, such as rubber. Here, the supporting axes 118 and 119 may be temporarily positioned by the temporary positioning members made of an elastic body, such as rubber, only on the rear side. Alternatively, the supporting axes 118 and 119 may be attached under the temporary positioning state, in which these supporting axes are movable with slight play, by establishing holes that are some what larger than the diameters of the supporting axes 118 and 119 in the supporting portion of the rear-side panel. The lengths of the supporting axes 118, 119, and 120 are set so that their rear-end portions significantly protrude from the rear-side panel and the tips of the rear-end portions of the supporting axes 118, 119, and 120 are formed in a tapered shape. Here, the three supporting axes 118, 119, and 120 may be attached with their front-end portions being positioned at regular positions on the front-side panel. Note that in FIG. 6, reference numeral 122 denotes a holding belt used to hold the intermediate transfer unit 104.

Figure 7:
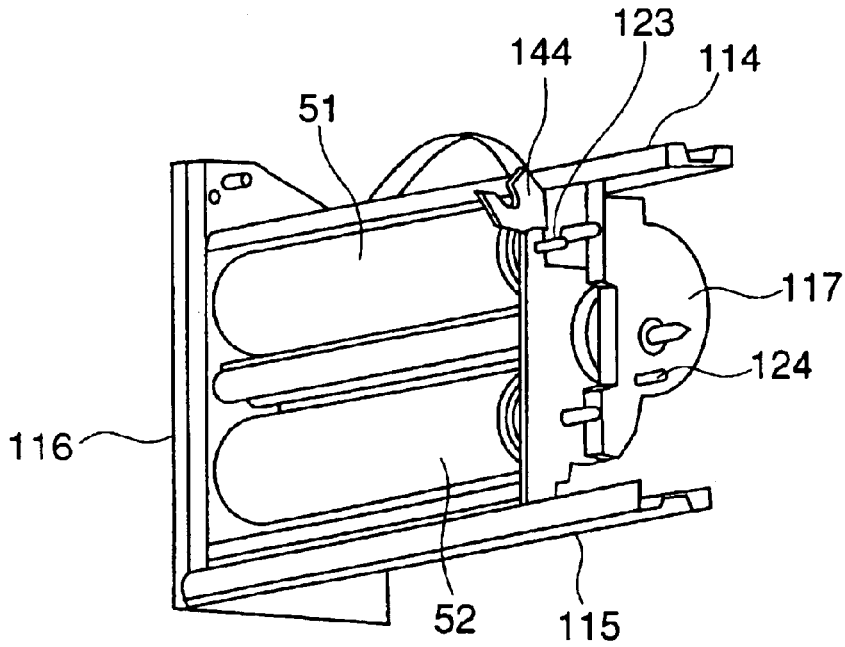
FIG. 7 is another external perspective view showing the intermediate transfer unit.
Figure 11:
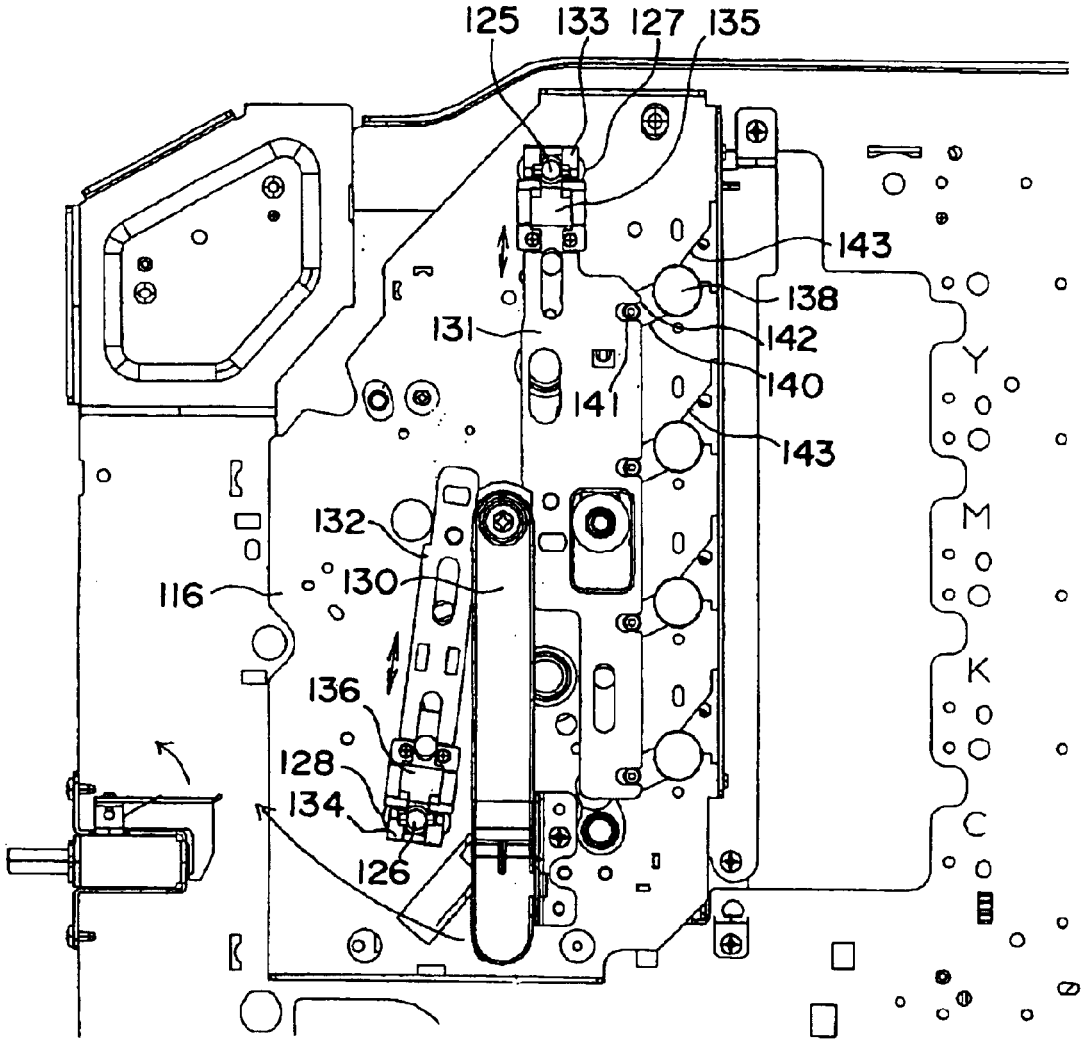
FIG. 11 is a front construction diagram showing a second positioning member.

As shown in FIG. 7, on the rear side of the intermediate transfer unit 104, two pins 123 and 124 for positioning and fixing the intermediate transfer unit 104 at the predetermined position of the printer main body 01 are protrudingly formed. Also, as shown in FIG. 11, on the front side of the intermediate transfer unit 104, two attachment holes 127 and 128 are established for inserting two pins 125 and 126 protrudingly formed on the front-side panel of the printer main body 01. When an operation lever 130 to be described later is rotationally operated, the two pins 125 and 126 protrudingly formed on the front-side panel of the printer main body 01 are locked to the intermediate transfer unit 104. Here, the locking of the two pins 125 and 126 to the intermediate transfer unit 104 is performed with the pins 125 and 126 being inserted into the attachment holes 127 and 128 established in the intermediate transfer unit 104.

Figure 12:
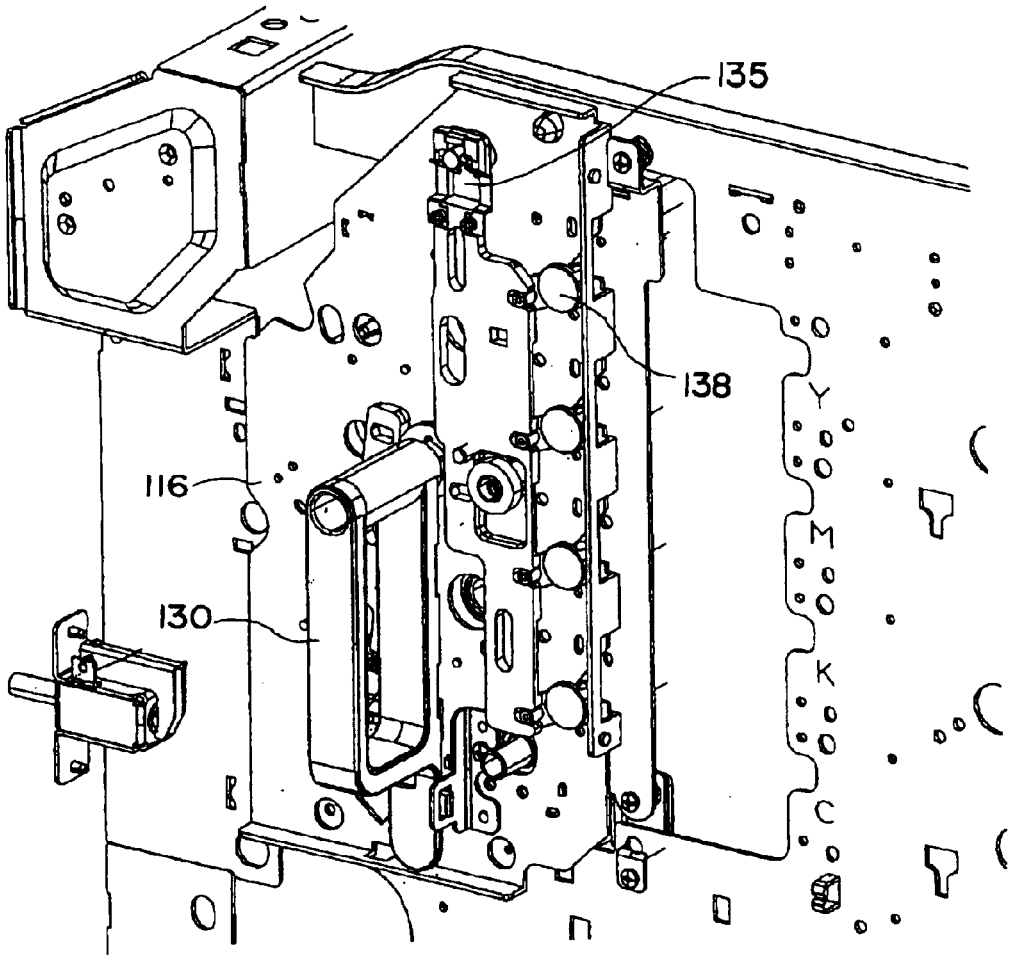
FIG. 12 is a perspective construction diagram showing the second positioning member.
Figure 13:
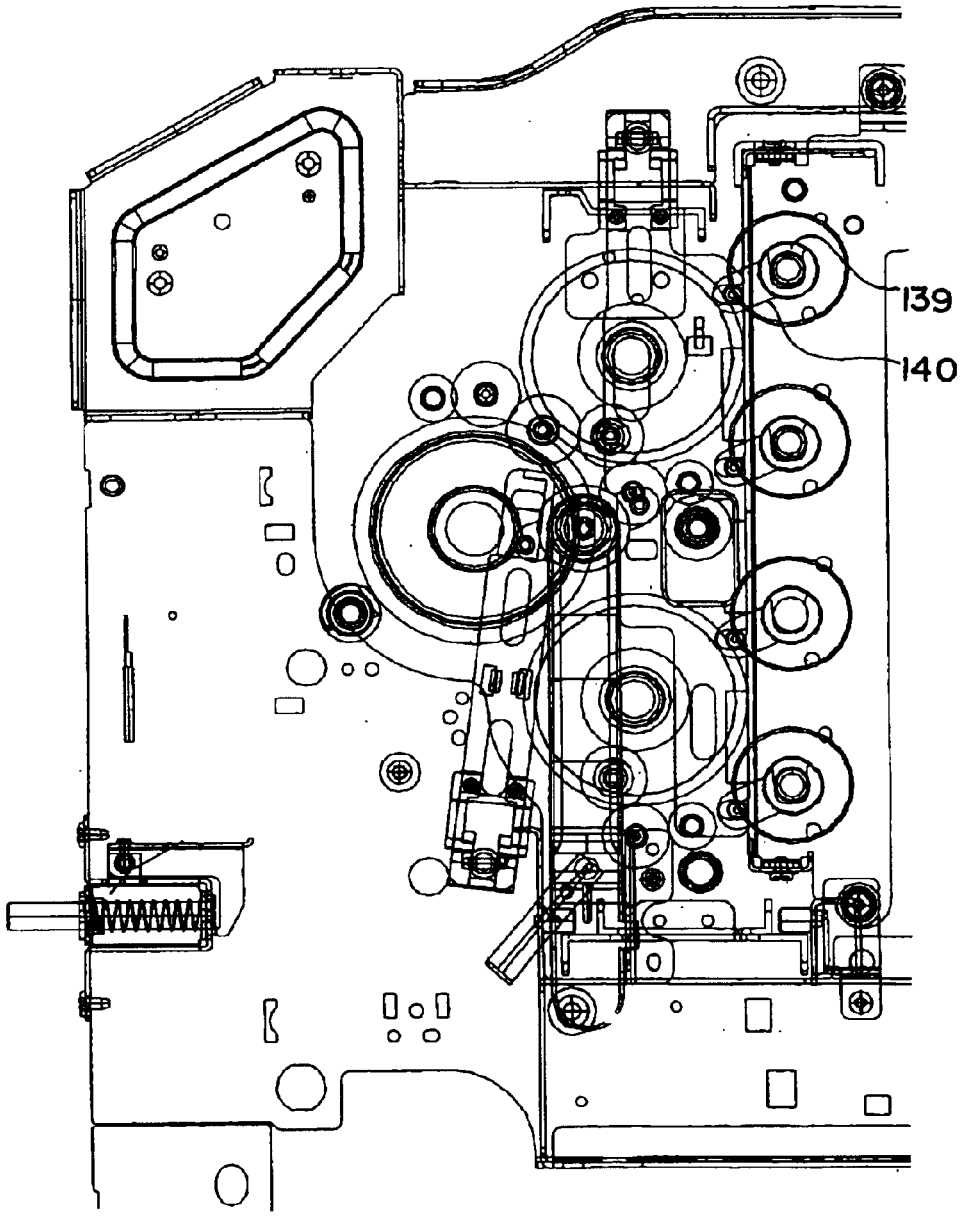
FIG. 13 is another front construction diagram showing the second positioning member.
Figure 14:
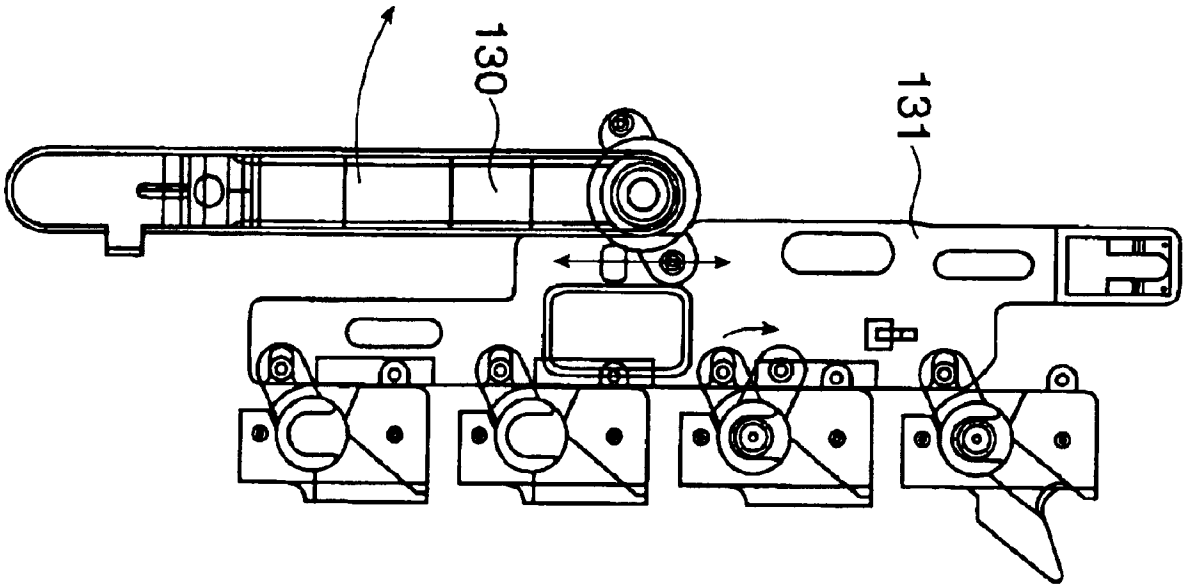
FIG. 14 is a front construction diagram showing a main portion of the second positioning member.

In addition, the front-side panel of the intermediate transfer unit 104 has a dual structure. As shown in FIGS. 11 and 12, to the surface-side panel 116 of the front panel of the dual structure, the operation lever 130 to be operated at the time of attachment of the intermediate transfer unit 104 to the printer main body 01 is attached so as to be rotational by around 90° in a clockwise direction. Also, two slide rods 131 and 132 that slide in a vertical direction in an interlocked manner with the rotational operation of the operation lever 130 are attached to the panel 116. As shown in FIG. 11, plate springs 133 and 134 for locking T-letter-shaped tip portions of the two pins 125 and 126 protrudingly formed on the front-side panel 116 of the printer main body 01 are respectively provided in an upper end portion of the slide rod 131 and an lower end portion of the slide rod 132. These plate springs 133 and 134 are respectively provided with rectangular opening portions 135 and 136 for inserting the pins 125 and 126.

Figure 15:
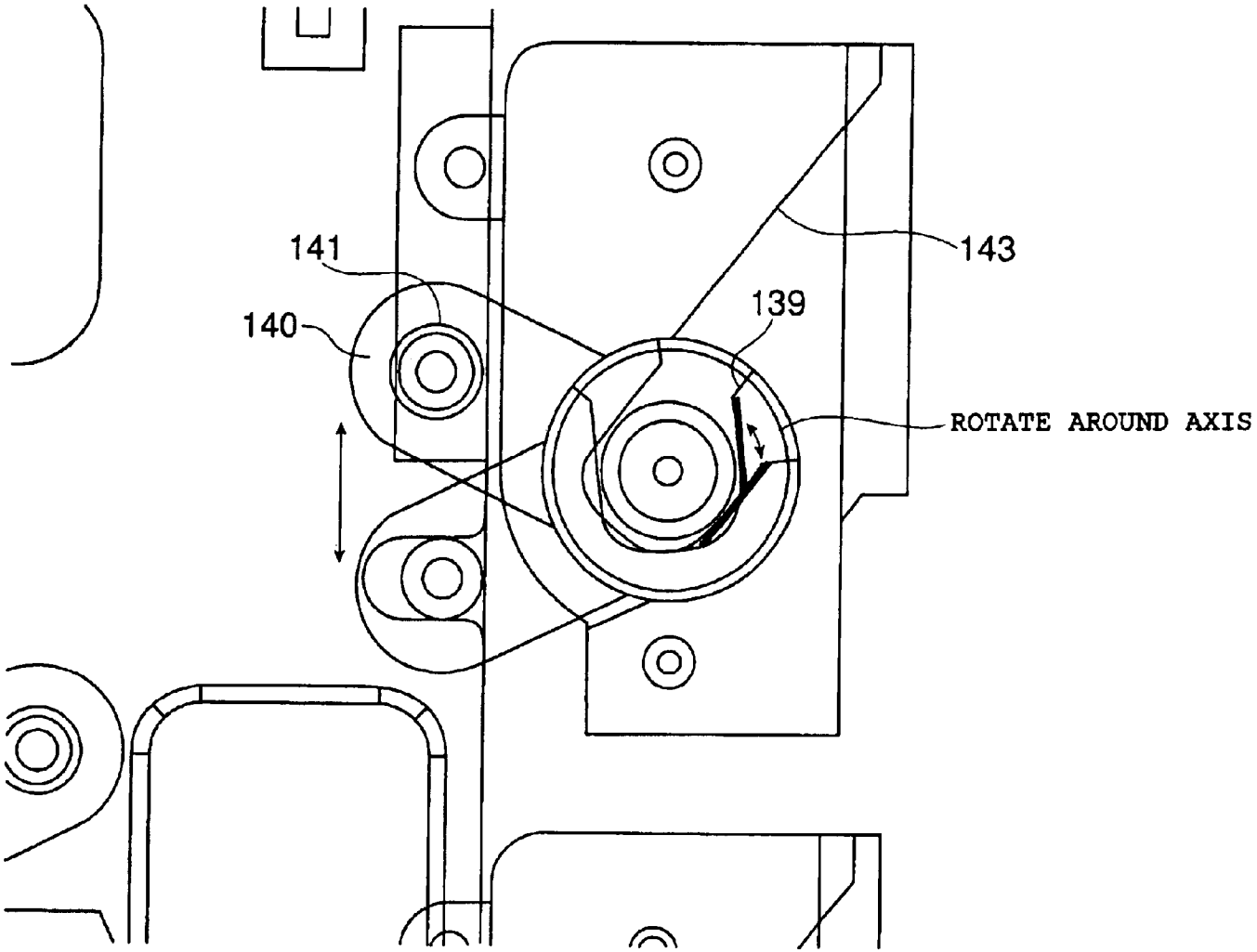
FIG. 15 is another front construction diagram showing the main portion of the second positioning member.
Figure 16:
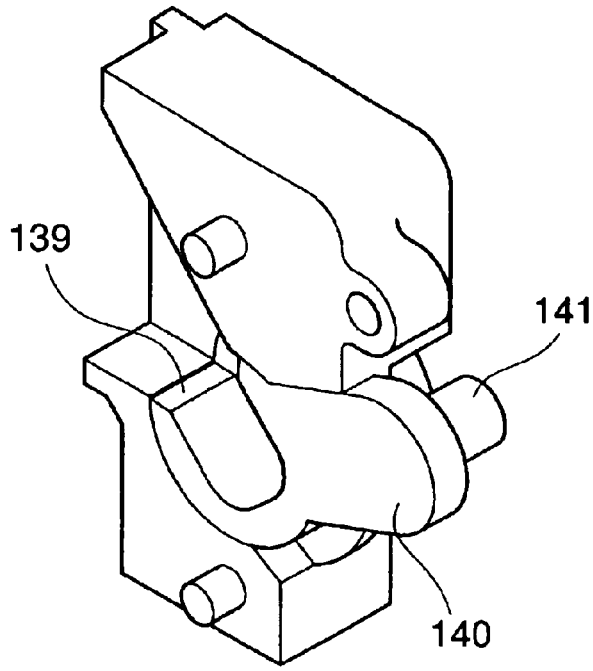
FIGS. 16(*a*) and 16(*b*) are each a perspective construction diagram showing a bearing member.
Figure 16:
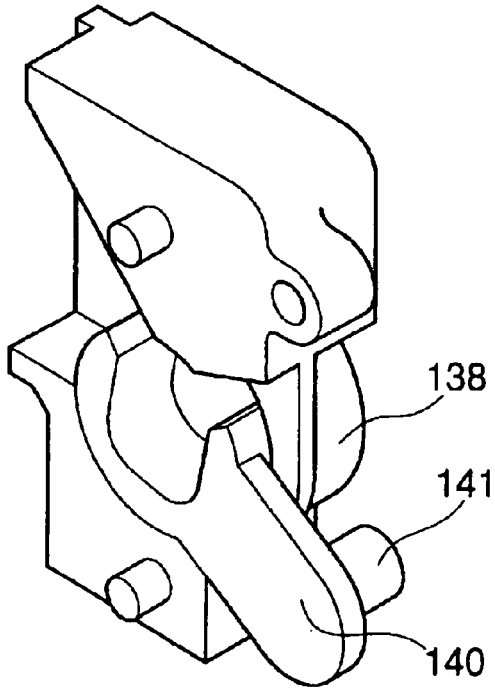
Figure 17:
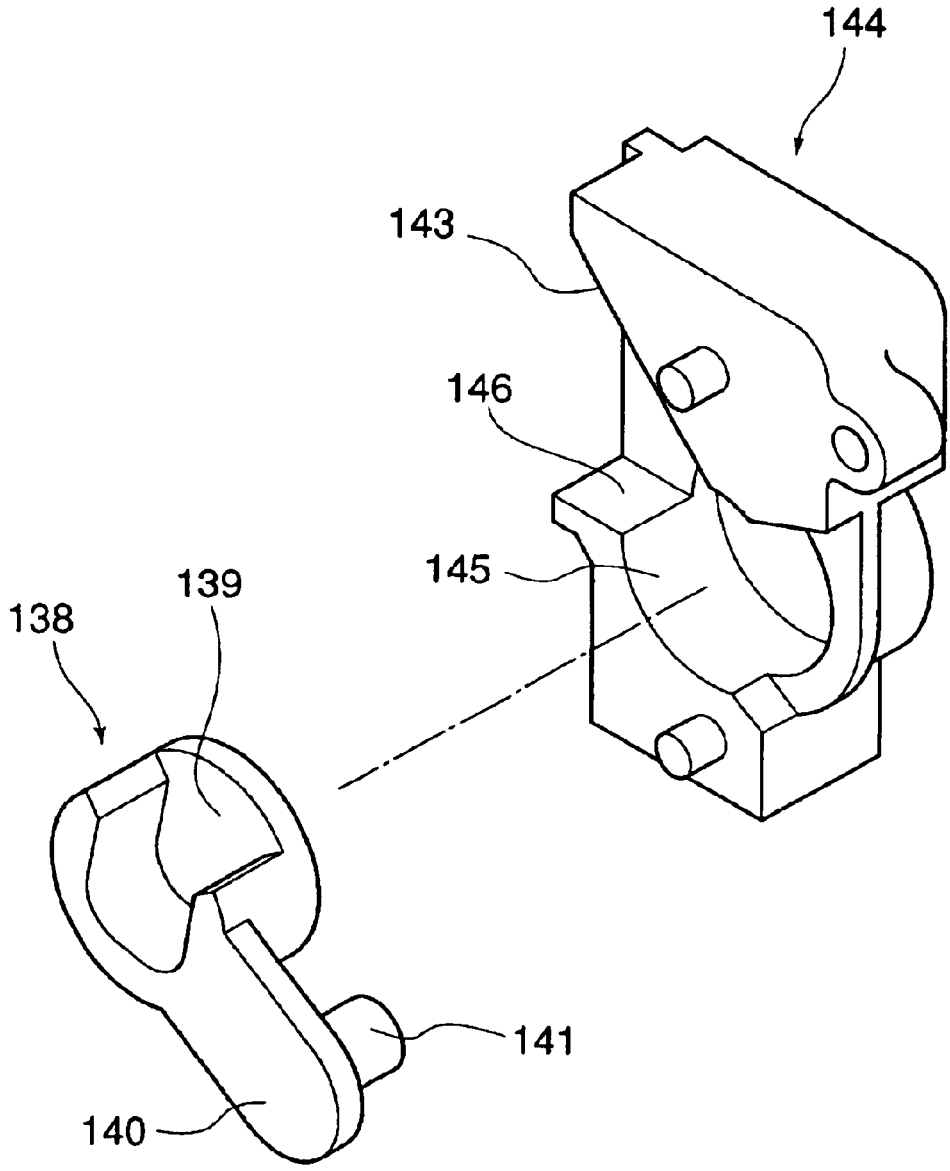
FIG. 17 is another perspective construction diagram showing the bearing member.

Also, as shown in FIG. 11, the intermediate transfer unit 104 is provided with a second positioning member 137 that positions and fixes the front-end portions of the supporting axes 109, 110, 111, and 112 of the photosensitive unit 103 at regular positions with the intermediate transfer unit 104 and the photosensitive unit 103 being integrally combined with each other. As shown in FIGS. 11 to 15, the second positioning member 137 includes bearing members 138 for pivotally supporting the front-end portions of the supporting axes of the photosensitive unit 103. As shown in FIGS. 16(*a*), 16(*b*), and 17, the bearing members 138 are each cut away in a portion 139 in the circumferential direction, thereby enabling the insertion of the supporting axes 109, 110, 111, and 112 of the photosensitive unit 103. Also, as shown in FIGS. 11, 12, and 15, the bearing members 138 are rotationally attached at predetermined positions of the front-side panel 116 of the intermediate transfer unit 104, and protrusions 141 protrudingly formed at tips of arm members 140 engage with grooves 142 established in the slide rod 131 on one side. With this construction, the bearing members 138 are rotated by following a sliding operation of the slide rod 131. In addition, portions 143 having an approximately V-letter shape are established in the front-side-panel 116 of the intermediate transfer unit 104 and guide the supporting axes 109, 110, 111, and 112 of the photosensitive unit 103 to the bearing members 138 of the positioning member. Note that in FIG. 7, reference numeral 144 denotes a placing member on which the uppermost supporting axis 109 of the photosensitive unit 103 is placed.

Figure 18:
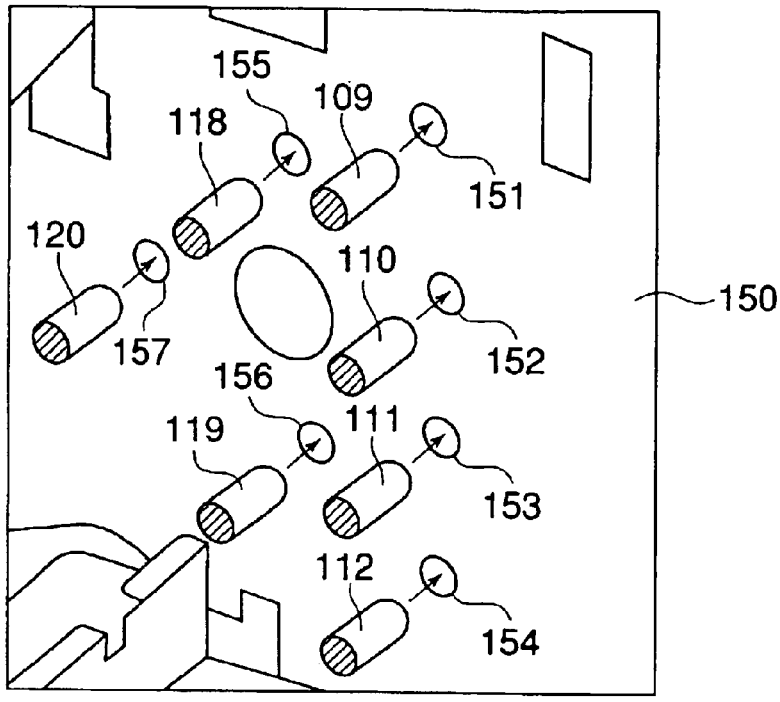
FIGS. 18(*a*) and 18(*b*) are each a perspective construction diagram showing a first positioning member.
Figure 18:
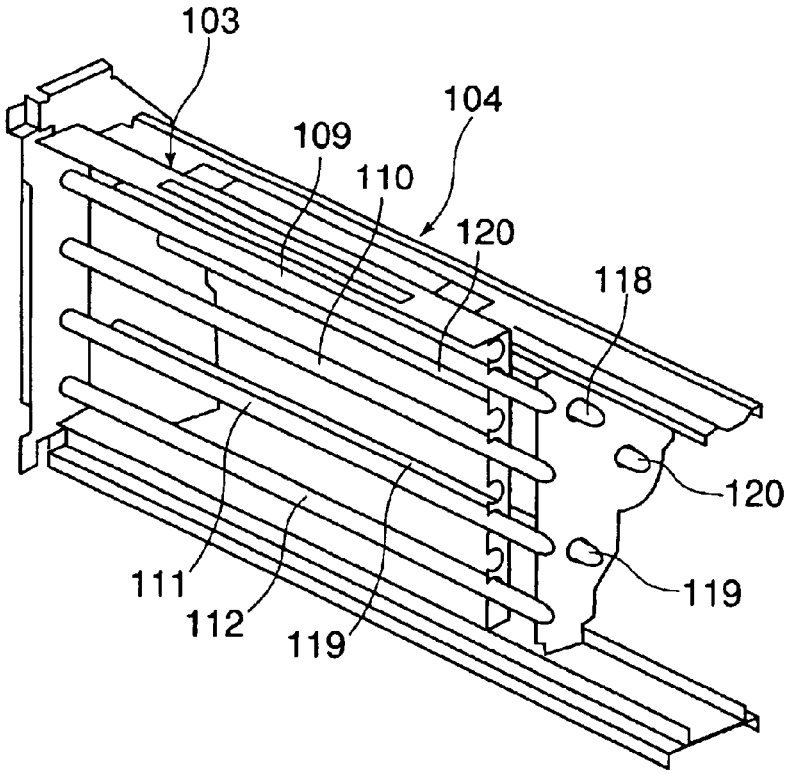

Referring to FIGS. 18(*a*) and 18(*b*), in a rear panel 150 of the printer main body 01, insertion holes 151, 152, 153, 154, 155, 156, and 157 are established each serving as a first positioning member for positioning the supporting axes 109, 110, 111, and 112 of the photosensitive unit 103 and the supporting axes 118, 119, and 120 of the intermediate transfer unit 104, respectively. These insertion holes 151, 152, 153, 154, 155, 156, and 157 are used to position the supporting axes 109, 110, 111, and 112 and the supporting axes 118, 119, and 120 at regular positions. When the photosensitive unit 103 and the intermediate transfer unit 104 are fitted to the predetermined positions of the printer main body 01, the supporting axes 109, 110, 111, and 112 of the photosensitive unit 103 and the supporting axes 118, 119, and 120 of the intermediate transfer unit 104 are fitted into the insertion holes 151, 152, 153, 154, 155, 156, and 157 to be positioned thereat. The rear panel 150 of the printer main body 01 is a member made of a single sheet-like metal, so that it is easy to precisely establish the insertion holes 151, 152, 153, 154, 155, 156, and 157 in the rear panel 150 in a predetermined positional relationship. Also, it is possible to perform precise positioning at the predetermined positions merely by fitting the supporting axes 109, 110, 111, 112 of the photosensitive unit 103 and the supporting axes 118, 119, and 120 of the intermediate transfer unit 104 into the insertion holes 151, 152, 153, 154, 155, 156, and 157. Note that it is desirable that the tip portions of the supporting axes 109, 110, 111, and 112 of the photosensitive unit 103 and the supporting axes 118, 119, and 120 of the intermediate transfer unit 104 are formed in a tapered shape. This is because with this construction, it becomes easy to fit the supporting axes 109, 110, 111, and 112 and the supporting axes 118, 119, and 120 into the insertion holes 151, 152, 153, 154, 155, 156, and 157.

Meanwhile, in this embodiment, the developing apparatuses are retractable in a direction in which the developing apparatuses are set close to/apart from the photosensitive drums.

Figure 19:
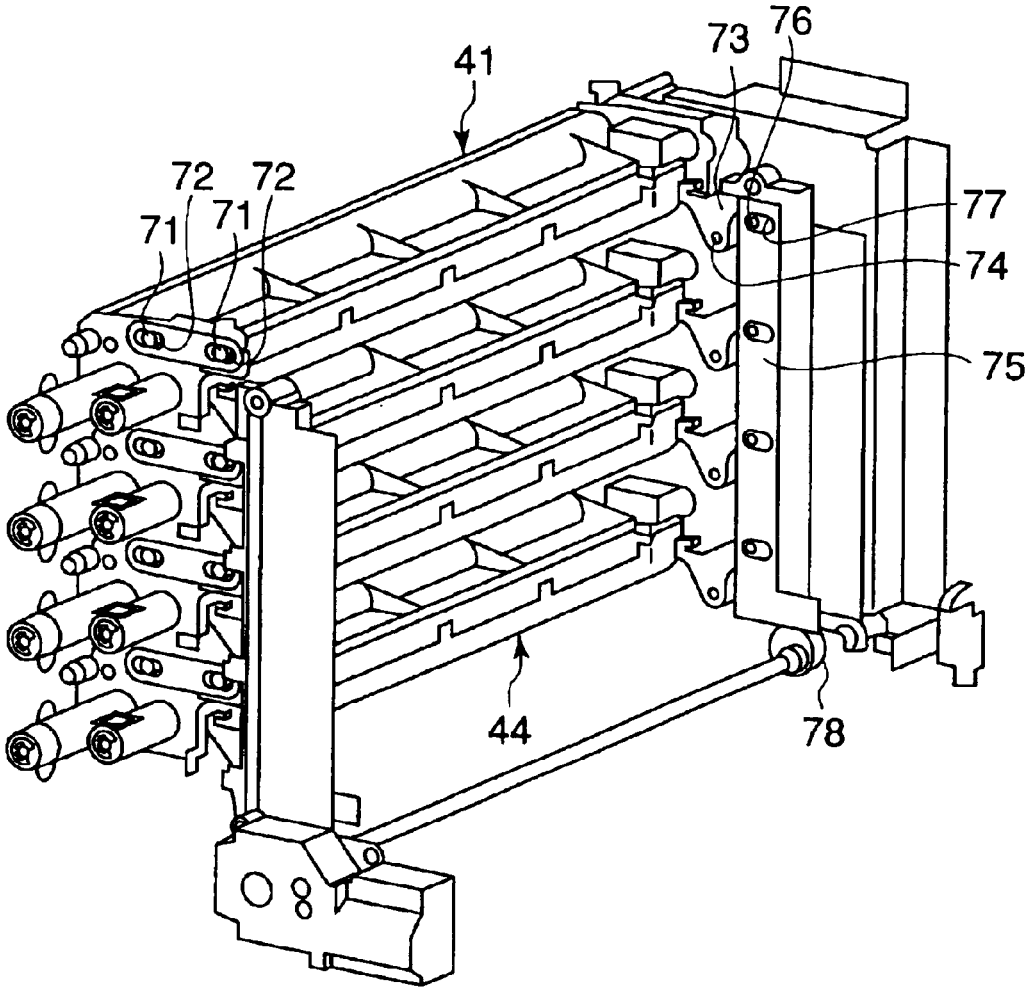
FIG. 19 is a perspective construction diagram showing a retracting mechanism of developing apparatuses.

FIG. 19 is a perspective view showing a retracting mechanism for setting the developing apparatuses according to the first embodiment of the present invention close to/apart from the photosensitive drums.

As shown in FIG. 19, the respective developing apparatuses 41, 42, 43, and 44 for yellow (Y), magenta (M), black (K), and cyan (C) are held by slide pins 71 provided for the printer main body 01 through longitudinal holes 72 so as to be slidable in a horizontal direction. On the back side of the respective developing apparatuses 41, 42, 43, and 44, actuation levers 73 for setting the developing apparatuses 41, 42, 43, and 44 close to/apart from the photosensitive drums 11, 12, 13, and 14 are disposed so as to be rockable about fulcrums 74. The four actuation levers 73 are operationally connected to a driving rod 75, which has an approximately L-letter shape and is disposed in the vertical direction on the back side of the developing apparatuses 41, 42, 43, and 44, through protrusions 76 and longitudinal holes 77. Also, the driving rod 75 having the approximately L-letter shape is driven in the vertical direction by an eccentric cam 78 disposed in a lower-end portion. Note that the retracting mechanism constructed in the manner described above is disposed on each of the rear side and the front side of the respective developing apparatuses 41, 42, 43, and 44.

Figure 20:
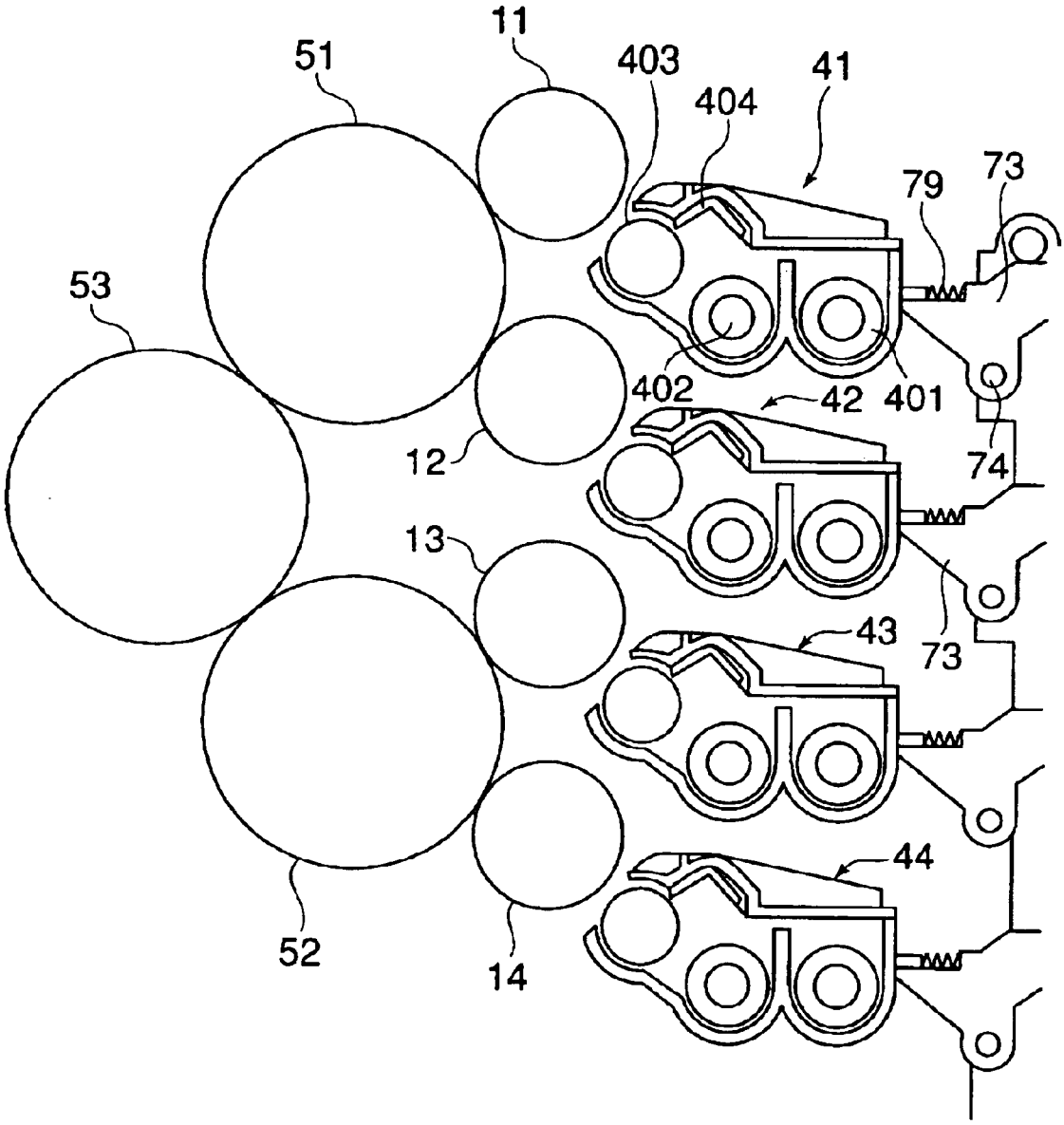
FIG. 20 is a construction diagram showing the developing apparatuses having the retracting mechanism.

With this construction, the developing apparatuses 41, 42, 43, and 44 for yellow (Y), magenta (M), black (K), and cyan (C) are moved close to/apart from the photosensitive drums 11, 12, 13, and 14 by, for instance, around 4 mm. That is, when the driving rod 75 having the approximately L-letter shape is driven in the vertical direction by the eccentric cam 78, the four actuation levers 73 operationally connected to the driving rod 75 through the protrusions 76 and the longitudinal holes 77 are rocked about the fulcrums 74 and the developing apparatuses 41, 42, 43, and 44 are pushed or pulled by these four actuation levers 73. Note that as shown in FIG. 20, springs 79 are attached to the actuation levers 73, thereby making it possible to smoothly set the developing apparatuses 41, 42, 43, and 44 close to/apart from the photosensitive drums 11, 12, 13, and 14.

Figure 21:
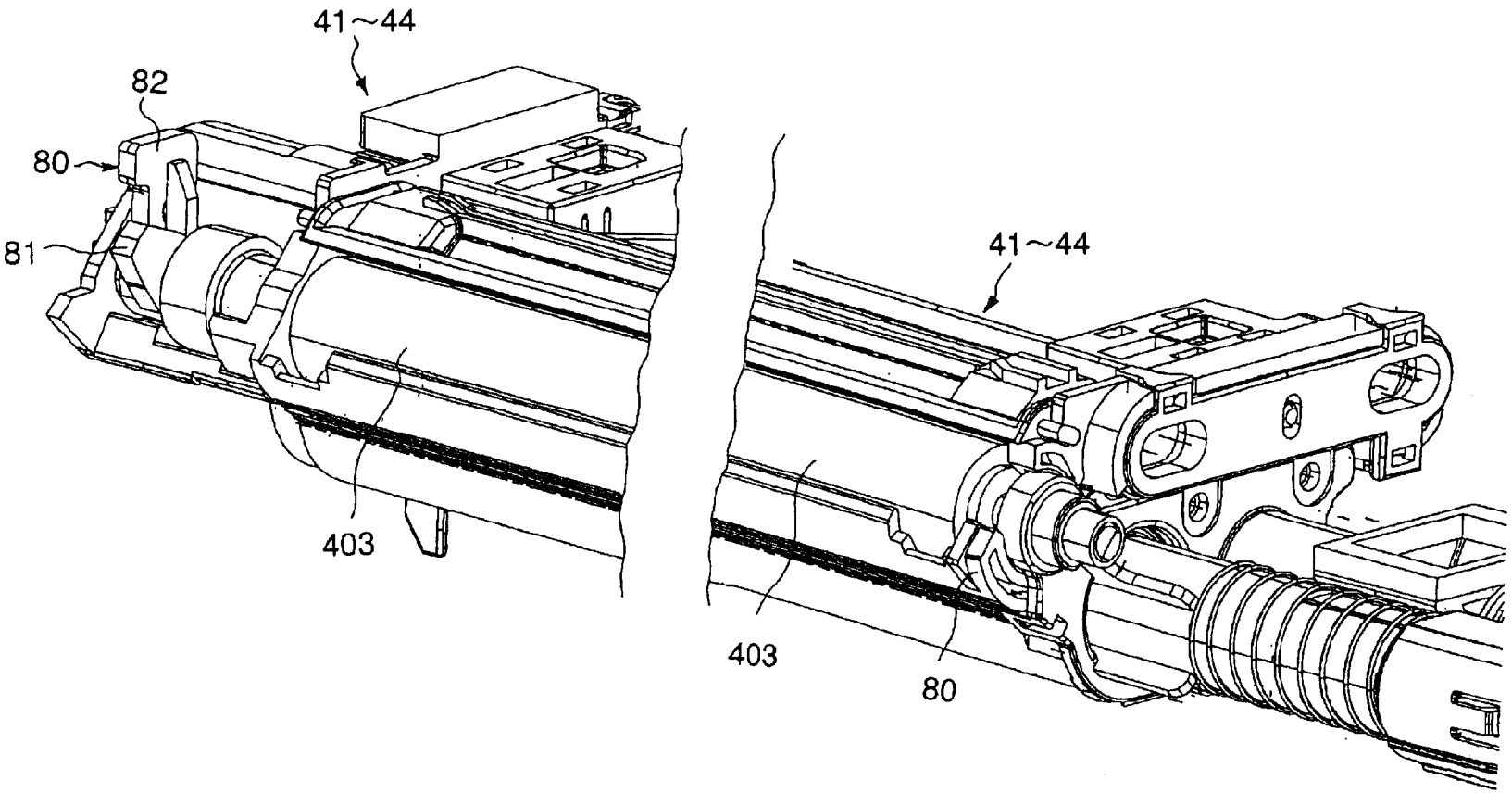
FIG. 21 is an external perspective view showing the developing apparatuses.

Referring to FIG. 21, in this embodiment, space setting members 80, which are made of a conductive material and set spaces between the developing rolls 403 and the photosensitive drums 11, 12, 13, and 14 at a predetermined value, are provided in end portions (both end portions) in the axis direction of the developing rolls 403 that each serve as a developer bearing body. In more detail, the space setting members 80 are fixed in proximity to the end portions in the axis direction of the developing rolls 403 of the developing apparatuses 41, 42, 43, and 44. Preferably, these space setting members 80 are made of a conductive member and are wear-resistant members, for instance. Also, for instance, the space setting members 80 are fitted around axes 405 of magnet rolls (not shown) fixed to the developing rolls 403 and are fixed under a predetermined state.

Figure 22:
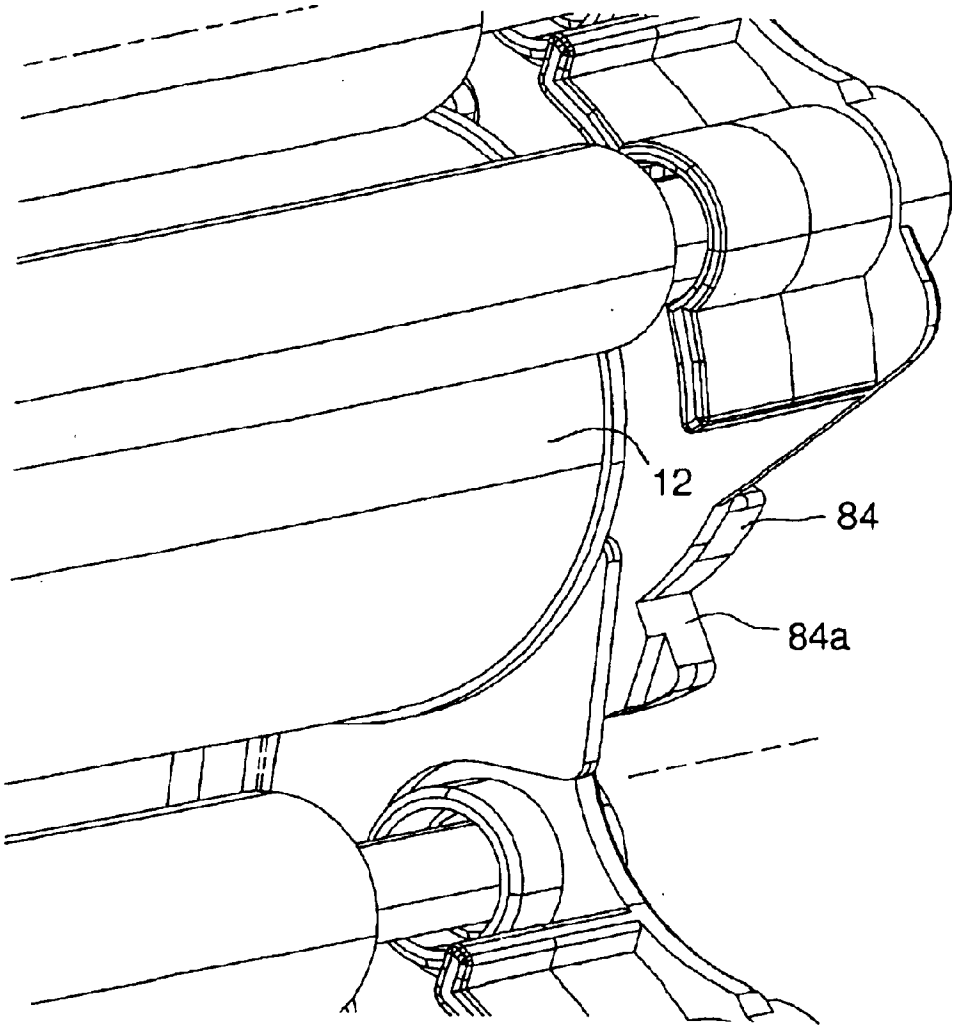
FIG. 22 is an external perspective view showing a main portion of the photosensitive unit.

As shown in FIG. 21, the space setting members 80 each include a space setting portion 81 protruding toward the photosensitive drums 11, 12, 13, and 14 side and a bias voltage receiving portion 82 protruding upwardly. Note that the bias voltage receiving portion 82 is provided only for the space setting portion 81 on the rear side and is not provided for the space setting portion 81 on the front side. Also, a tip end portion 81*a* of the space setting portion 81 protruding like a plate toward the photosensitive drums 11, 12, 13, and 14 side is formed in a curved shape having multiple convex portions 85 and 86. On the other hand, as shown in FIG. 22, supporting members 83 rotationally supporting the photosensitive drums 11, 12, 13, and 14 are each provided with a positioning member 84. A portion 84*a* of the positioning member 84, against which the tip portion 81*a* of the space setting portion 81 is bumped, is formed in a concave shape whose cross section has an approximately V-letter shape. With this construction, the space setting portion 81 point-contacts the positioning member 84 in multiple portions (two portions in the illustrated example).

Figure 23:
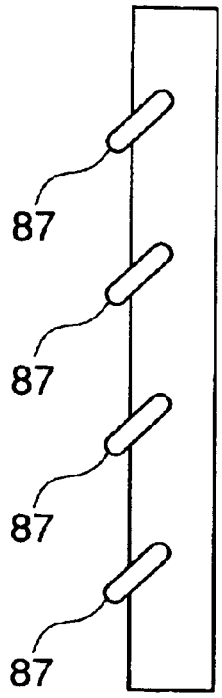
FIGS. 23(*a*) and 23(*b*) are each a construction diagram showing a developing bias applying member.
Figure 23:
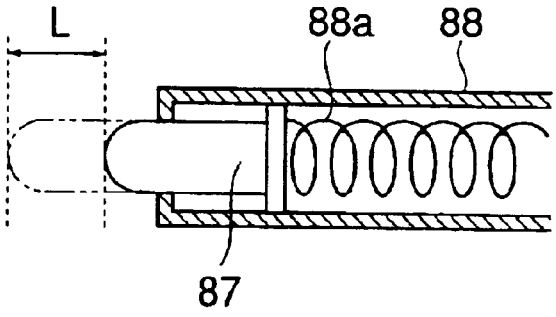

In addition, as shown in FIG. 21, bias voltage application electrodes 87 for applying a bias voltage that is a predetermined high voltage to the respective developing apparatuses 41, 42, 43, and 44 are protrudingly formed on the rear side of the developing apparatuses 41, 42, 43, and 44. As shown in FIG. 23, the bias voltage application electrodes 87 are each slidably fitted inside a cylindrical case 88 while being energized by a spring 88*a*. With this construction, the bias voltage application electrode 87 is capable of protruding from the cylindrical case 88 by a length L and pressure-contacts the bias voltage receiving portion 82 of the space setting member 80. As a result, a predetermined bias voltage is applied to each developing roll 403 through the space setting member 80.

As described above, as shown in FIG. 22, the supporting members that rotationally support the photosensitive drums 11, 12, 13, and 14 are each provided with the positioning member 84 made of POM or another material. This positioning member 84 includes the positioning portion having the concave portion 84*a* against which the space setting member 80 is abutted for positioning. The positioning member 84 also includes insertion holes 89 into which the axes of the photosensitive drums 11, 12, 13, and 14 are rotationally inserted.

By the way, the image forming apparatus according to this embodiment is shipped with the developing members being fitted to the apparatus main body. When doing so, a developer leakage preventing member for preventing leakage of the developers from the developing members is fitted to an attachment position opposing the developing members in place of a component that is detachably attachable to the apparatus main body at the attachment position.

In this embodiment, the detachably attachable component is a regularly-replaced component that is, for instance, an image forming unit including the image bearing bodies. Also, the developer leakage preventing member is provided with positioning protrusions that are fitted into the holes established in the apparatus main body for the positioning of the image bearing bodies.

In addition, in this embodiment, the developing members are movable between a position opposing the image bearing bodies and a position retracted from the image bearing bodies and are set to be in an immovable state when the developer leakage preventing member is fitted to the apparatus main body.

In this embodiment, an image forming apparatus that is shipped with a developing member being fitted to an apparatus main body, including: a developer leakage preventing member that prevents leakage of a developer from the developing member, wherein the developer leakage preventing member is fitted to the apparatus main body in place of an image bearing body opposing the developing member and is fixed to the apparatus main body using a member that is also used to fix the image bearing body thereto.

In this embodiment, a developer leakage preventing member that is fitted to an image forming apparatus shipped with a developing member being attached to an apparatus main body so as to oppose an intermediate transfer body, and which prevents leakage of a developer from the developing member, the developer leakage preventing member including: a first surface having a shape with which an opening portion of the developing member is closed; and a second surface having a shape that approximately resembles a part of a shape of the intermediate transfer body.

Further in this embodiment, a method for shipping/transporting an image forming apparatus with a developing member being fitted to an apparatus main body, including: at the time of shipment, retracting a unit including the developing member to a rearward and fitting a developer leakage preventing member in place of an image bearing body unit opposing the developing member; and after transportation, detaching the developer leakage preventing member and fitting the image bearing body unit.

In this embodiment, as shown in FIG. 3, the print head device 02 is broadly divided into the process cartridge 101 and the developing apparatus unit 102. Also, the process cartridge 101 is divided into the photosensitive unit 103 (the first unit) having the four photosensitive drums 11, 12, 13, and 14, the contact-type electrification apparatuses 21, 22, 23, and 24, and the refreshers 25, 26, 27, and 28, and the intermediate transfer unit 104 (the second unit) having the three intermediate transfer drums 51, 52, and 53 and the cleaning rolls 54, 55, and 56. Here, the process cartridge 101 is detachably attachable to the printer main body 01 and, at the time of detachment from the printer main body 01, the process cartridge 101 is pulled out toward the frontward side.

The tandem-type full-color printer according to this embodiment is shipped from a factory under the state shown in FIGS. 2 and 3 where the developing apparatus unit 102 is fitted to the printer main body 01. Each of the developing apparatuses 41, 42, 43, and 44 of the developing apparatus unit 102 is filled with the developer. Also, in the full-color printer, the developing apparatuses 41, 42, 43, and 44 are retracted to positions at which these apparatuses are set apart from the photosensitive drums 11, 12, 13, and 14. By doing so, there is prevented a situation where the developing rolls 403 of the respective developing apparatuses 41, 42, 43, and 44 abut against the surfaces of the photosensitive drums 11, 12, 13, and 14 to damage these surfaces.

By the way, if the full-color printer is shipped from a factory under this state and is sent to a stockroom or the like or is delivered to a user, this leads to a situation where the developers leak from the opening portions of the developing apparatuses 41, 42, 43, and 44 due to vibrations, shocks, and the like at the time of transport. This leakage of the developers from the opening portions of the developing apparatuses 41, 42, 43, and 44 occurs even when the photosensitive drums 11, 12, 13, and 14 are fitted because spaces exist between the developing apparatuses 41, 42, 43, and 44 and the photosensitive drums 11, 12, 13, and 14. Also, this developer leakage occurs more prominently when the photosensitive drums 11, 12, 13, and 14 are not fitted.

Figure 24:
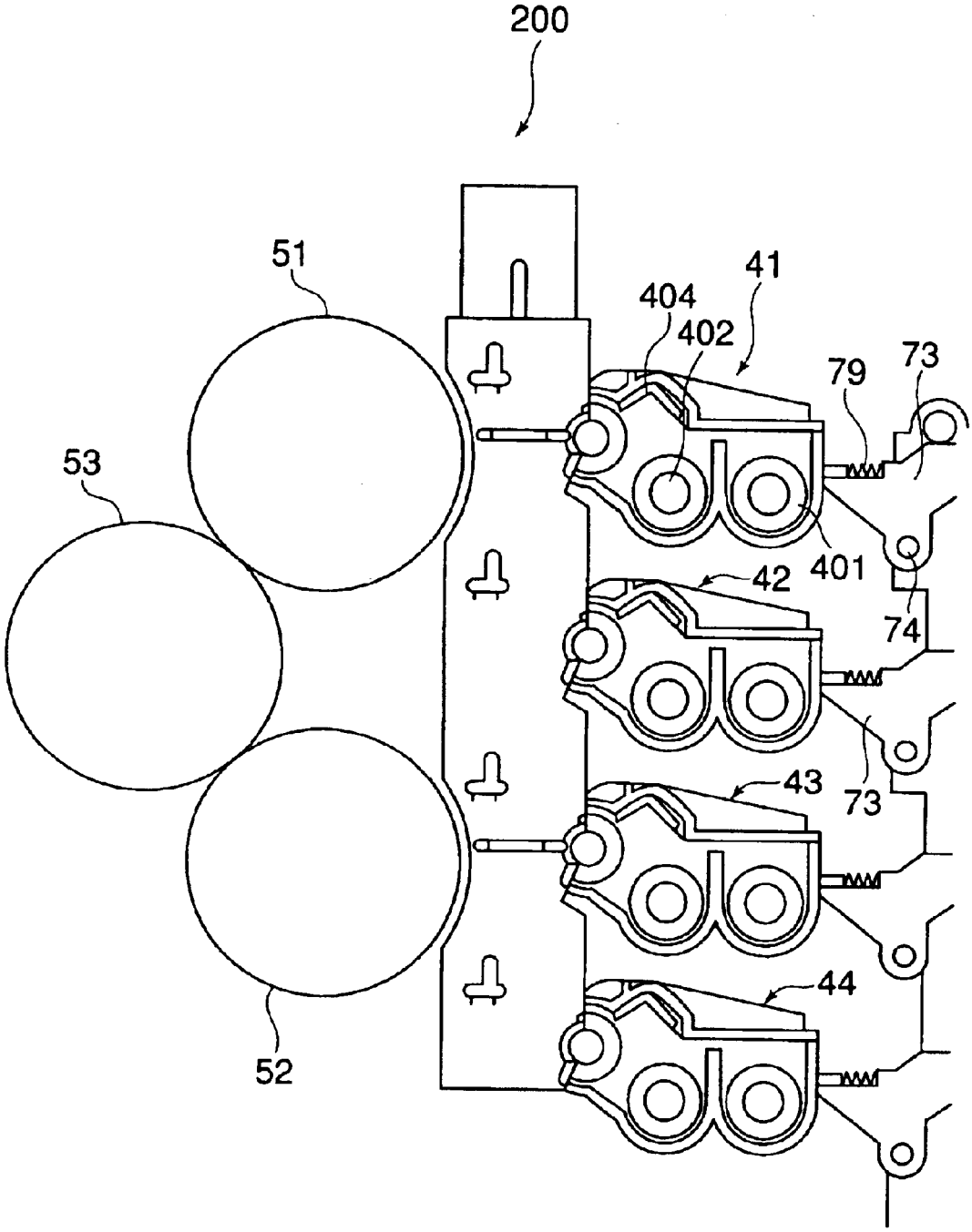
FIG. 24 is a construction diagram showing the developing apparatuses to which a developer leakage preventing member is fitted.

Therefore, in this embodiment, as shown in FIG. 24, a developer leakage preventing member 200 for preventing the leakage of the developers from the developing apparatuses 41, 42, 43, and 44 is fitted. This developer leakage preventing member 200 is a component that is detachably attachable to the printer main body 01 at a position opposing the developing apparatuses 41, 42, 43, and 44, that is, at an attachment position of the photosensitive unit 103.

Figure 25:
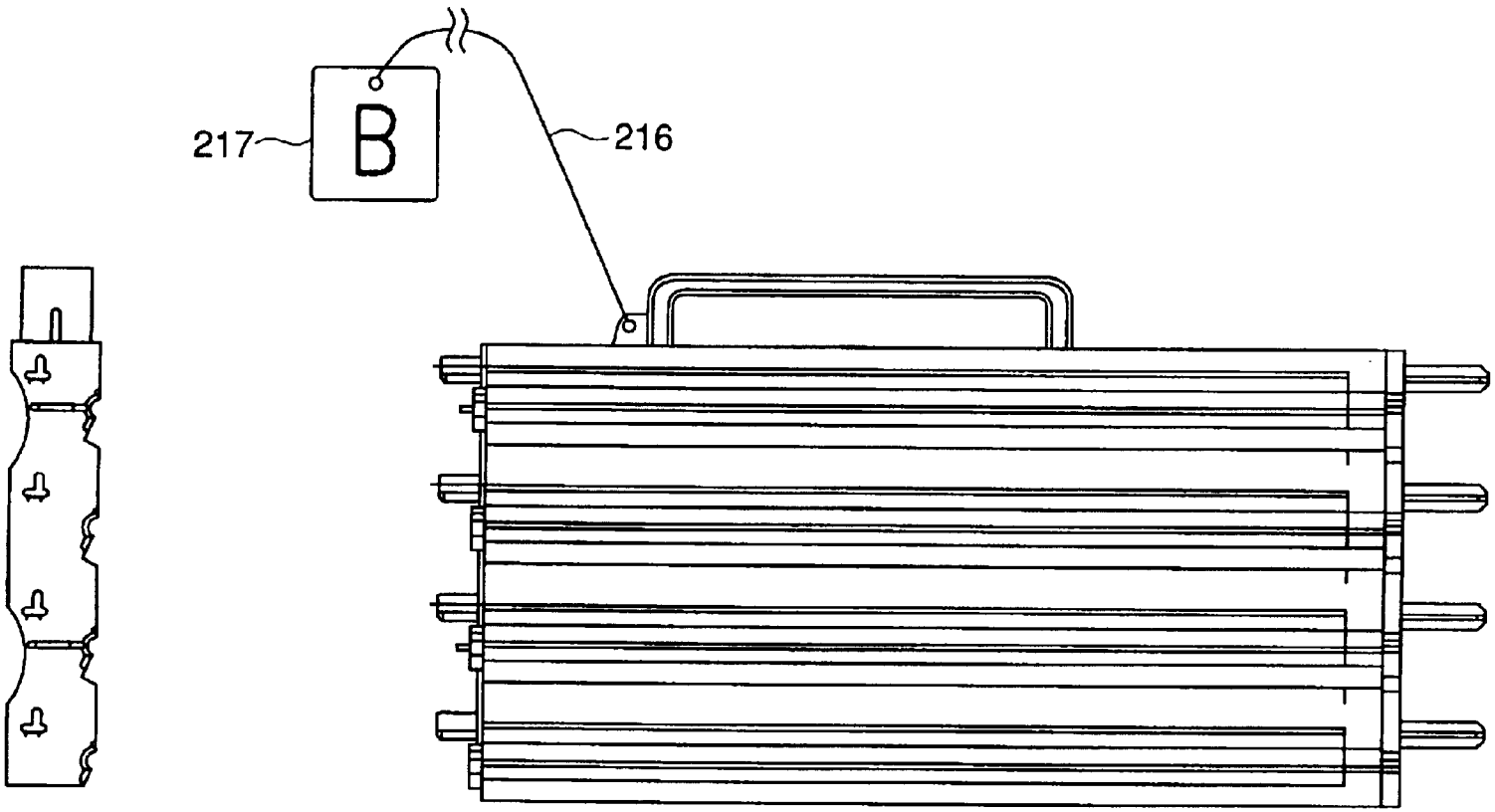
FIG. 25 is a construction diagram showing the developer leakage preventing member.

The developer leakage preventing member 200 is made of a synthetic resin, such as ABS, and has an approximately vertical rectangular parallelepiped external shape resembling the external shape of the photosensitive unit 103, as shown in FIG. 25. Also, a surface on the intermediate transfer drums 51 and 52 side of the developer leakage preventing member 200 is fully opened. Note that although the external shape of the developer leakage preventing member 200 is set approximately the same as that of the photosensitive unit 103, the width of the developer leakage preventing member 200 is set somewhat larger than that of the photosensitive unit 103. With this construction, the developer leakage preventing member 200 abuts against the housing of the developing apparatuses 41, 42, 43, and 44 under the state where the developing apparatuses 41, 42, 43, and 44 are retracted.

Figure 1:
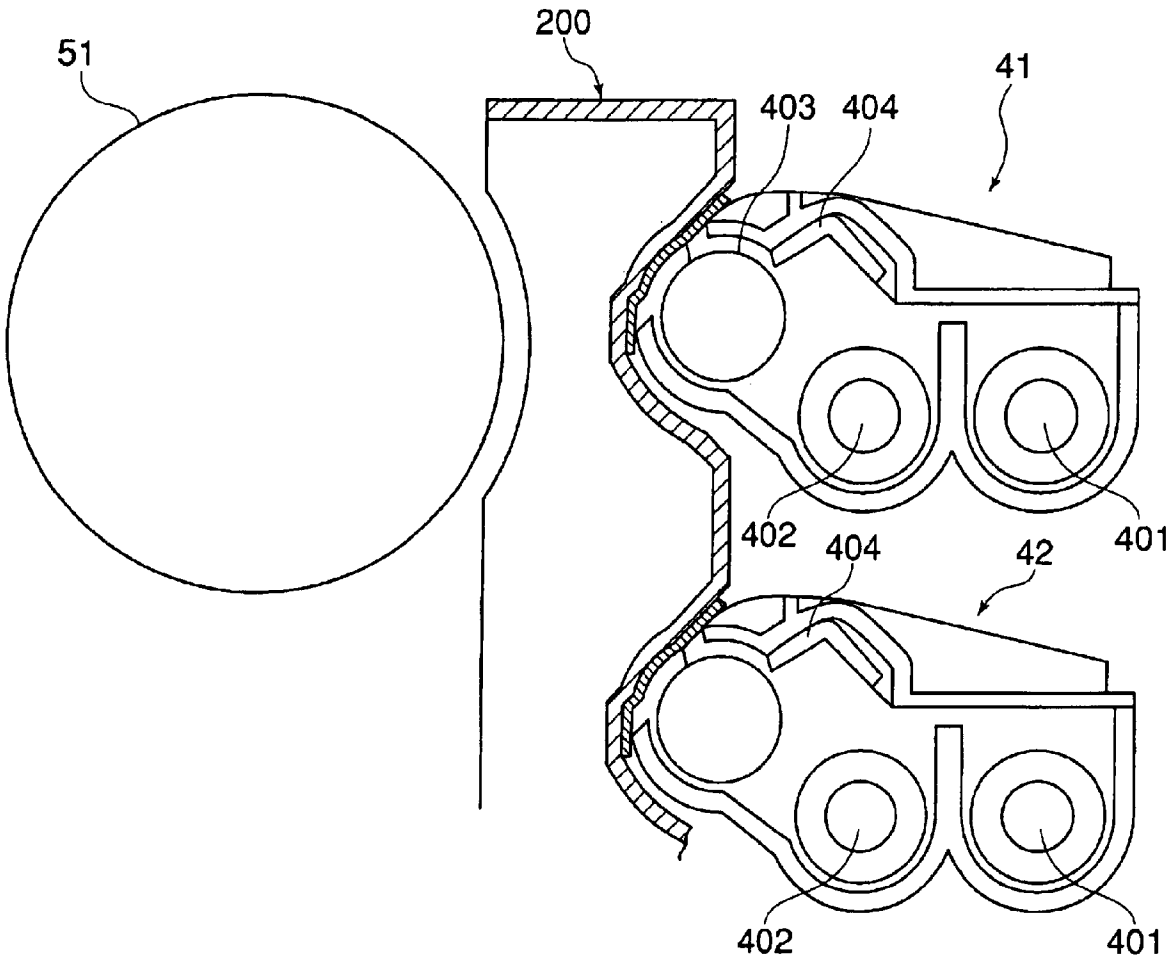
FIG. 1 is a cross-sectional construction diagram showing a main portion of an image forming apparatus according to a first embodiment of the present invention.
Figure 26:
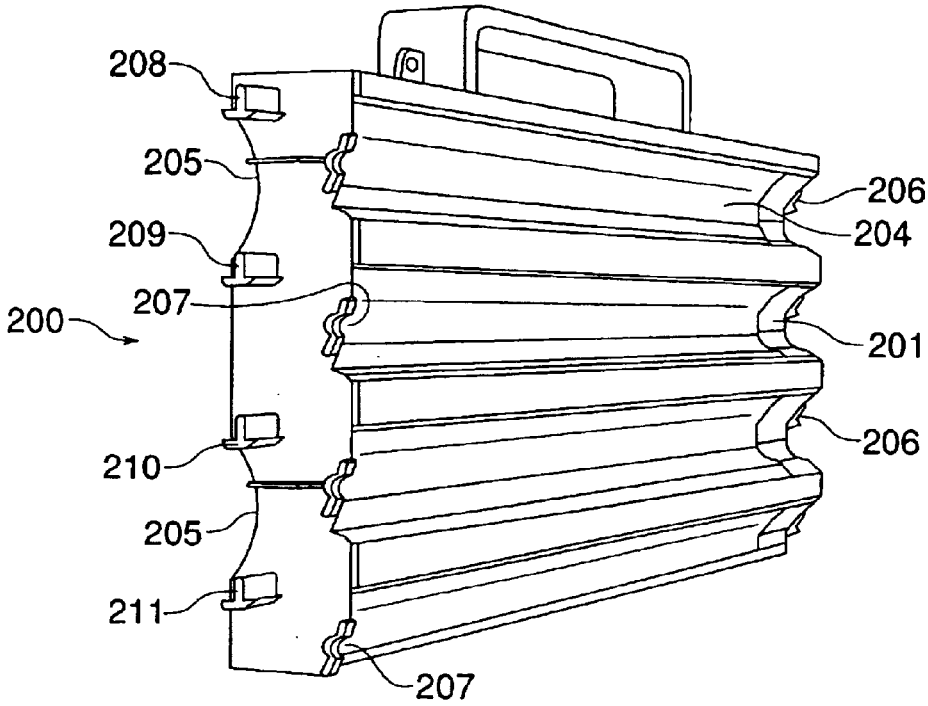
FIGS. 26(*a*) and 26(*b*) are each an external perspective view showing the developer leakage preventing member.
Figure 26:
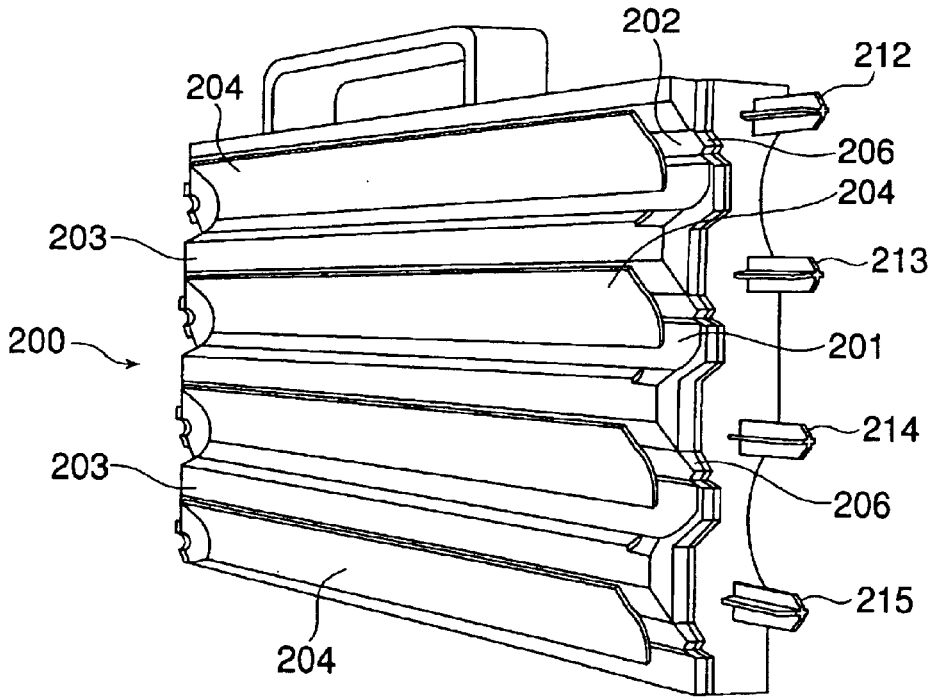

In more detail, as shown in FIGS. 1, 25, 26(*a*), and 26(*b*), a side surface 201 (first surface) of the developer leakage preventing member 200 on the developing apparatuses 41, 42, 43, and 44 side is shaped in accordance with the external shapes of the developing apparatuses 41, 42, 43, and 44. Also, portions 202 corresponding to the opening portions, through which the developing rolls 403 of the developing apparatuses 41, 42, 43, and 44 are exposed, are formed as cylindrically curved surfaces whose outside diameters are set larger than those of the developing rolls 403. Further, portions 203 of the developer leakage preventing member 200 between the developing apparatuses 41, 42, 43, and 44 are formed as vertical planes integrally continued from the surfaces on the developing apparatuses 41, 42, 43, and 44 side. Still further, sheet-shaped seal members 204 are provided for the inside surface of the developer leakage preventing member 200 using an adhesive or the like in areas corresponding to the opening portions through which the developing rolls 403 of the developing apparatuses 41, 42, 43 and 44 are exposed. Here, the seal members 204 are made of an urethane resin or the like and are set wider than the opening widths of the opening portions.

In addition, the side surface of the developer leakage preventing member 200 on the intermediate transfer drums 51 and 52 side is fully opened and portions 205 (second surface) corresponding to the surfaces of the intermediate transfer drums 51 and 52 are cut away in a circular arc shape.

Also, the developer leakage preventing member 200 includes concave portions 206, against which the space setting members 80 of the developing apparatuses 41, 42, 43, and 44 are abutted, in the rear-side end portion of the side surface on the developing apparatuses 41, 42, 43, and 44 side. Also, concave portions 207, against which the axis portions of the developing rolls 403 of the developing apparatuses 41, 42, 43, and 44 are abutted, are provided in the front-side end portion of the developer leakage preventing member 200.

Further, as shown in FIGS. 26(*a*) and 26(*b*), four protrusions 208, 209, 210, and 211 corresponding to the front-end portions of the four supporting axes 109, 110, 111, and 112 of the photosensitive drums 11, 12, 13, and 14 are protrudingly formed on the front-side end surface of the developer leakage preventing member, and four protrusions 212, 213, 214, and 215 corresponding to the rear-end portions of the four supporting axes 109, 110, 111, and 112 are protrudingly formed on the rear-side end surface of the developer leakage preventing member. Like the four supporting axes 109, 110, 111, and 112 of the photosensitive drums, the protrusions 208, 209, 210, and 211 on the front side are fitted into and are positioned by the concave portions 139 of the bearing members 138 and the protrusions 212, 213, 214, and 215 on the rear side are fitted into and are positioned by the insertion holes 151, 152, 153, 154, 156, and 157 of the rear panel 150 (see FIG. 18(*a*)).

As shown in FIG. 24, at the time of shipment of the full-color printer, the developer leakage preventing member 200 is fitted to the printer main body 01 instead of the photosensitive unit 103 in completely the same manner as in the case of the photosensitive unit 103 (see FIGS. 8 and 9).

However, in the case of the developer leakage preventing member 200, the developing apparatuses 41, 42, 43, and 44 are retracted to positions at which they are retracted and set apart from the photosensitive drums 11, 12, 13, and 14. Under this state, as shown in FIGS. 1 and 24, the developer leakage preventing member 200 fitted to the printer main body 01 covers the opening portions of the retracted developing apparatuses 41, 42, 43, and 44 without generating any gaps.

Also, in this embodiment, when the developer leakage preventing member is fitted to the apparatus main body, the image forming apparatus is set inoperable. In this embodiment, in order to set the image forming apparatus inoperable under the state where the developer leakage preventing member is fitted to the apparatus main body, a storage medium is used which is provided for the image forming unit and stores identification information with reference to which the image forming unit is identified on the apparatus main body side.

Also, in this embodiment, in order to set the image forming apparatus inoperable under the state where the developer leakage preventing member is fitted to the apparatus main body, an operation prohibition displaying tag is used which is provided for the developer leakage preventing member and is exhibited outside the apparatus main body.

That is, in this embodiment, as shown in FIG. 5, a storage medium M that stores predetermined information and is capable of communicating with the printer main body 01 is attached to the photosensitive unit 103. Under the state where the photosensitive unit 103 is fitted to the printer main body 01, the storage medium M performs communication with the printer main body 01 and, only when the photosensitive unit 103 is identified on the printer main body 01 side, a print operation is allowed.

Accordingly, under the state where the developer leakage preventing member 200 is fitted to the printer main body 01 instead of the photosensitive unit 103, the photosensitive unit 103 is not identified on the printer main body 01 side and any image forming operation is prohibited.

With this construction, there is prevented a situation where a print operation is started under the state where the developer leakage preventing member 200 is fitted to the printer main body 01 causing the retracting mechanism of the developing apparatuses 41, 42, 43, and 44 to be damaged.

Also, in this embodiment, as shown in FIG. 25, an operation prevention displaying tag 217 exhibited outside the apparatus main body is connected to the developer leakage preventing member 200 using a plastic string 216 containing a wire. At the time of shipment, this operation prohibition displaying tag 217 is pulled out outside the printer main body 01 and is visually exhibited. Also, a note describing that the printer main body 01 will not operate so long as the developer leakage preventing member 200 is detached is written in an instruction manual or the like.

With this construction, there is prevented a situation where a print operation is started under the state where the developer leakage preventing member 200 is fitted to the printer main body 01 causing the retracting mechanism of the developing apparatuses 41, 42, 43, and 44 is damaged.

It should be noted here that it is of course possible to adopt only one of the storage medium M and the operation prohibition displaying tag 217.

With the above construction of the full-color printer according to this embodiment, in addition to an effect of preventing the leakage of the developers from the developing apparatuses due to vibrations and the like at the time of transportation, there are provided effects that it is possible to attach the developer leakage preventing member even when the image forming apparatus is miniaturized and it is possible to easily perform attachment and detachment of the developer leakage preventing member at the time of use of the image forming apparatus. These effects will be described in detail below.

As shown in FIGS. 1 and 24, at the time of shipment of the full-color printer according to this embodiment, the developer leakage preventing member 200 is fitted inside the printer main body 01 in place of the photosensitive unit 103. The external shape of the developer leakage preventing member 200 is formed to be approximately the same as that of the photosensitive unit 103. Therefore, in completely the same manner as in the case of the photosensitive unit 103, the developer leakage preventing member 200 is fitted into the printer main body 01 together with the intermediate transfer unit 104 (see FIGS. 8 and 9).

When doing so, like the photosensitive unit 103, the developer leakage preventing member 200 is inserted toward the rear-side end portion of the printer main body 01 while being guided by the guide rails 114 and 115 provided for the intermediate transfer unit 104 and the guide rails provided for the printer main body 01. When the insertion is completed, the supporting axes 118, 119, and 120 of the intermediate transfer unit 104 and the axis members 212, 213, 214, and 215 of the developer leakage preventing member 200 are fitted into and positioned by the insertion holes 151, 152, 153, 154, 155, 156, and 157 of the rear panel 150. Then, the handle 130 is rotationally operated and the developer leakage preventing member 200 is fixed to the printer main body 01 together with the intermediate transfer unit 104 by the locking mechanism.

Under this state, as shown in FIG. 1, the developer leakage preventing member 200 covers the opening portions on the developing roll side of the developing apparatuses 41, 42, 43, and 44 and hermetically seals the opening portions with the seal members 204 without generating any gaps. As a result, even when the full-color printer receives vibrations, shocks, and the like during transportation or the like, it becomes possible to prevent the leakage of the developers from the opening portions of the developing apparatuses 41, 42, 43, and 44 using the developer leakage preventing member 200. Also, the developer leakage preventing member 200 is not fitted at a position that is different from the position of each member, which is originally provided in the full-color printer, but is fitted at the position of the photosensitive unit 103, which is originally fitted to the full-color printer, in place of the photosensitive unit 103. As a result, it becomes possible to sufficiently cope with a case where the full-color printer is miniaturized. Further, the leakage of the developers from the four developing apparatuses 41, 42, 43, and 44 of the full-color printer is prevented using only one developer leakage preventing member 200. Therefore after transportation, at the time of use of the full-color printer, it is sufficient that the intermediate transfer unit 104 is pulled out from the printer main body 01 and the photosensitive unit 103 is fitted in place of the developer leakage preventing member 200. As a result, there are facilitated the attachment and detachment of the developer leakage preventing member 200.

Second Embodiment

Figure 27:
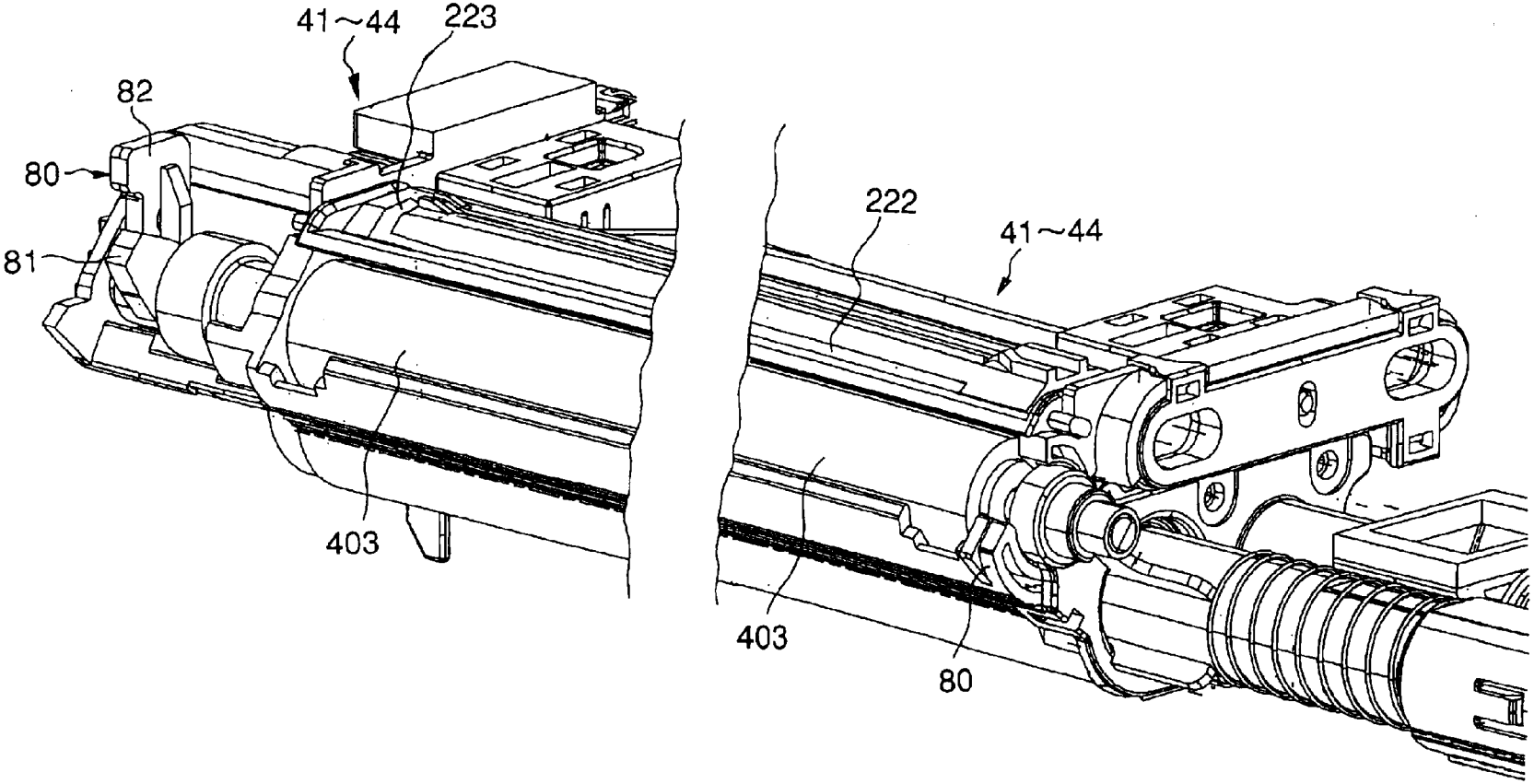
FIG. 27 is a cross-sectional construction diagram showing developing apparatuses of an image forming apparatus according to a second embodiment of the present invention.

FIG. 27 shows a second embodiment of the present invention. In this drawing, the same construction elements as in the first embodiment are given the same reference numerals and the description thereof is omitted. In this embodiment, the developing members are provided with guide rails for guiding the developer leakage preventing member and, at the time of fitting, the developer leakage preventing member is guided by the guide rails. Also, at a position at which the fitting is finished, the seal members of the developer leakage preventing member are abutted against the housing of the developing part. With this construction, the fitting path of the developer leakage preventing member and the fitting path of the image forming unit are set different from each other.

In the above first embodiment, as shown in FIGS. 8 and 9, the developer leakage preventing member 200 is fitted while linearly sliding toward the rear side of the printer main body 01 together with the intermediate transfer unit 104. Therefore, it is required that the rear-side end surface of the developer leakage preventing member 200 does not rub against the surfaces of the developing rolls 403 exposed through the opening portions of the developing apparatuses 41, 42, 43, and 44 during the fitting operation. Therefore, it is impossible to seal the rear-side and front-side side surfaces of the opening portions of the developing apparatuses 41, 42, 43, and 44 with the developer leakage preventing member 200. As a result, there is a danger that if vibrations are given with the printer main body 01 being vertically placed, the developers may leak from the side surface on the rear side or front side of the opening portions of the developing apparatuses 41, 42, 43, and 44.

Figure 28:
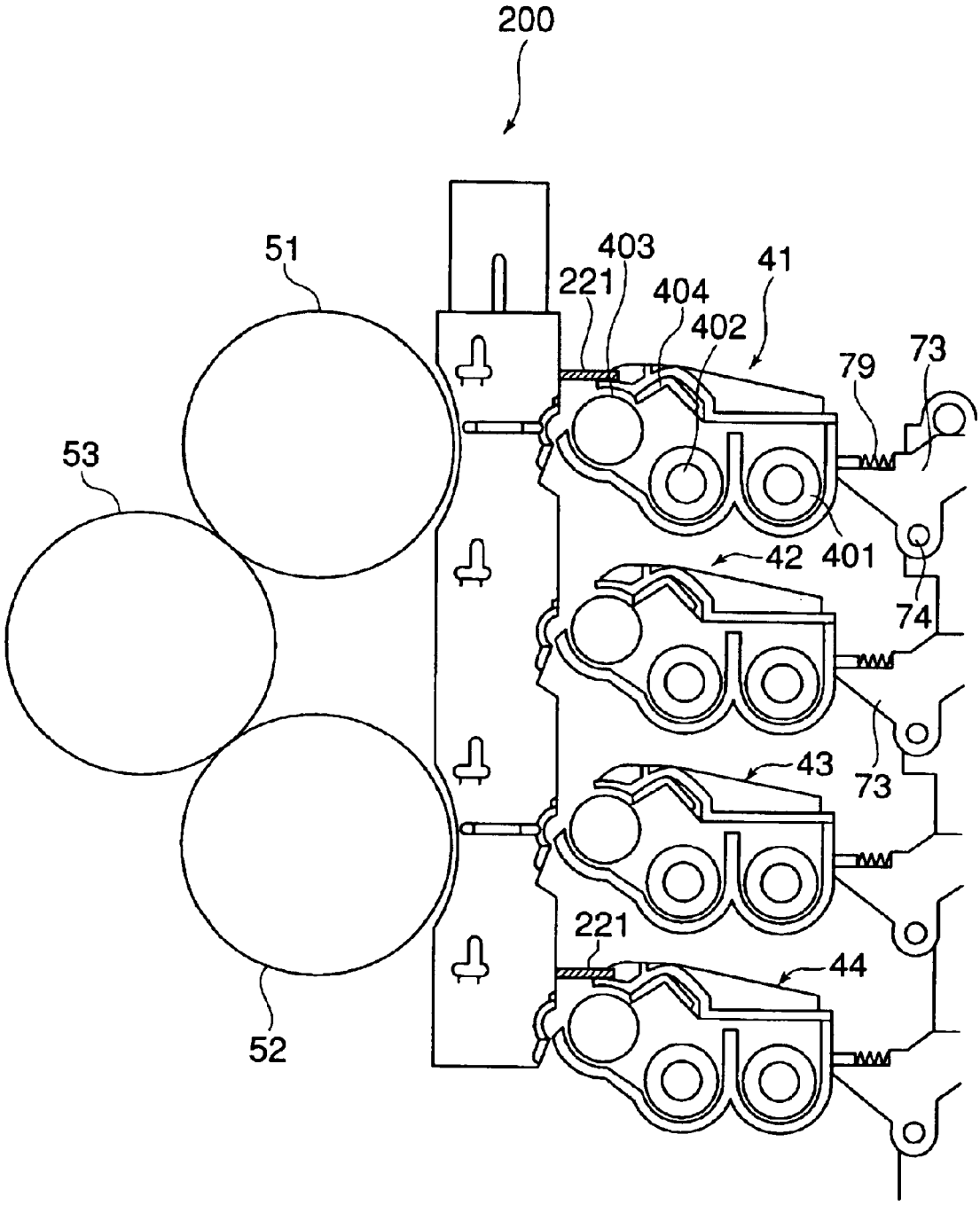
FIG. 28 is a construction diagram showing the developing apparatuses to which a developer leakage preventing member is fitted.
Figure 29:
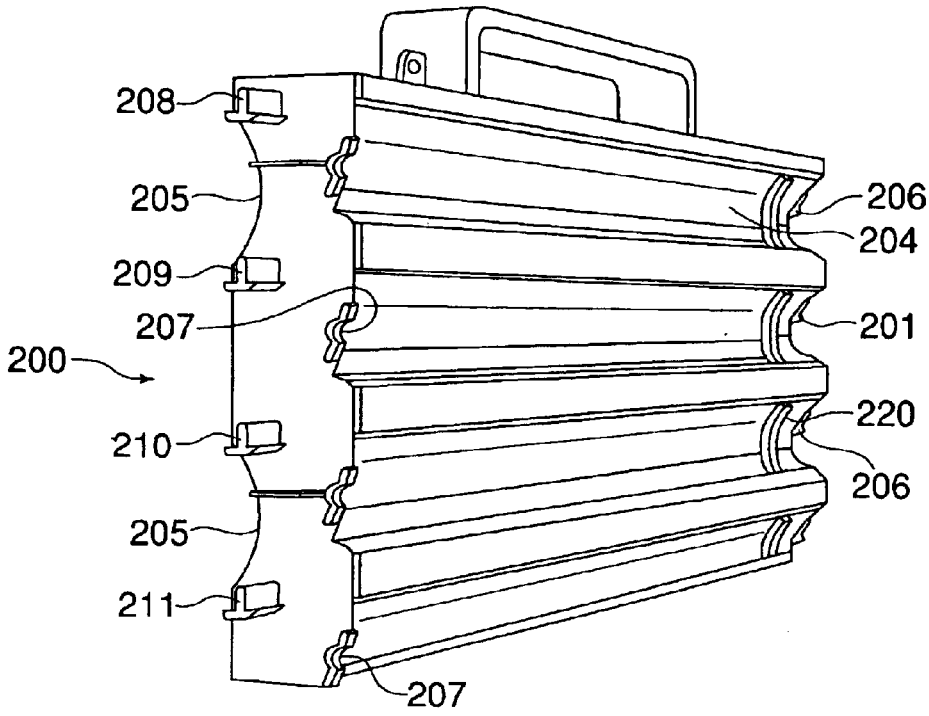
FIGS. 29(*a*) and 29(*b*) are each an external perspective view showing the developer leakage preventing member.
Figure 29:
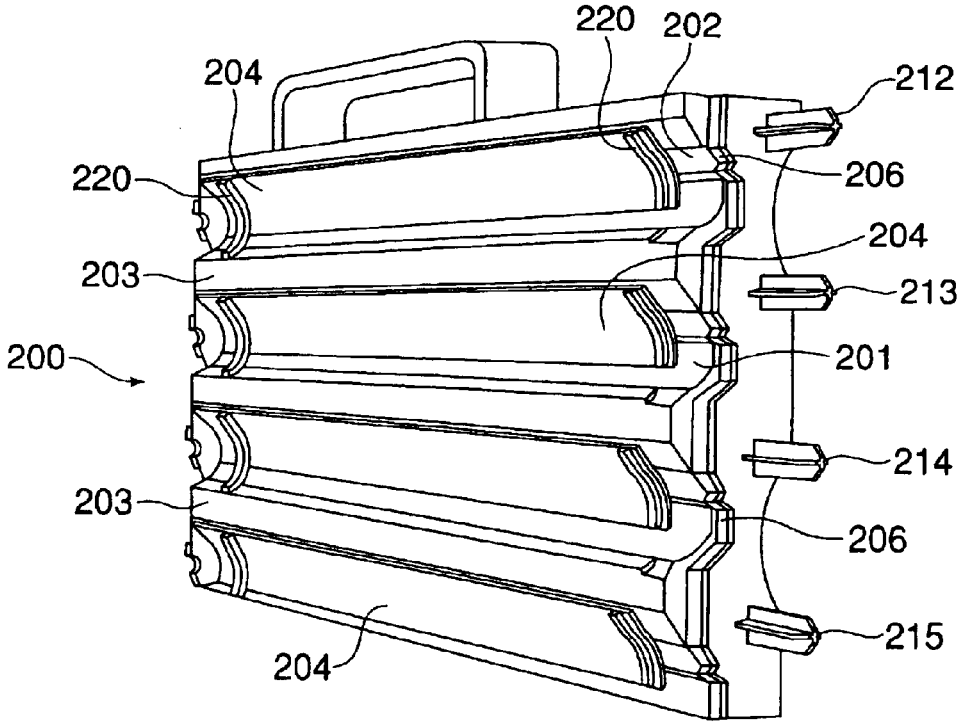

In view of this problem, in this second embodiment, the developer leakage preventing member 200 is provided with seal members 220 for sealing the rear-side and the front-side side surfaces of the opening portions of the developing apparatuses 41, 42, 43, and 44, as shown in FIGS. 29(*a*) and 29(*b*). Also, as shown in FIGS. 27 and 28, the developer leakage preventing member 200 is provided with guide portions 221 and the uppermost developing apparatus 41 and the lowermost developing apparatus 44 are provided with guide rails 222. With this construction, the developer leakage preventing member 200 is inserted toward the rear side of the printer main body 01 while being spaced apart from the developing apparatuses 41, 42, 43, and 44. Further, as shown in FIG. 27, a guide groove 223 for moving the developer leakage preventing member toward the developing apparatus side is provided in proximity to a position at which the fitting of the developer leakage preventing member 200 is finished. With this construction, when the fitting is completed, the developer leakage preventing member 200 completely seals the rear-side side surfaces and the front-side side surfaces of the opening portions of the developing rolls 403 of the developing apparatuses 41, 42, 43, and 44 as well as the front surfaces of the opening portions with the seal members 204 and the seal members 220.

Other constructions and operations are the same as those described in the first embodiment, so that the description thereof is omitted.

Third Embodiment

In this third embodiment, the image forming unit itself is used as the developer leakage preventing member and the full-color printer is shipped with the developing members being moved to developing positions opposing the image bearing bodies.

That is, in this third embodiment, the full-color printer is shipped under the state shown in FIG. 20 where not the developer leakage preventing member 200 but the photosensitive unit 103 is fitted to the printer main body 01 and the developing apparatuses are set at the developing positions opposing the photosensitive unit 103.

With this construction, it becomes possible to prevent the leakage of the developers using the photosensitive unit 103 fitted to the printer main body 0l. As a result, the developer leakage preventing member becomes unnecessary.

It should be noted here that in this embodiment, the developing apparatuses are set at the developing positions opposing the photosensitive unit 103 by the retracting mechanism, so that it also becomes possible to prevent a situation where the developing apparatuses involuntarily move and abut against the photosensitive drums.

Other constructions and operations are the same as those described in the above embodiments, so that the description thereof is omitted.

What is claimed is:

1. An image forming apparatus that is shipped with a developing member being fitted to an apparatus main body, comprising:

a developer leakage preventing member that prevents leakage of a developer from the developing member, wherein the developer leakage preventing member is fitted at an attachment position opposing the developing member in place of a component that is detachably attachable to the apparatus main body at the attachment position.

2. An image forming apparatus according to claim 1, wherein the detachably attachable component is a regularly-replaced component.

3. An image forming apparatus according to claim 2, wherein the regularly-replaced component is an image forming unit including an image bearing body, wherein the apparatus main body is provided with a positioning portion for the image bearing body, and the developer leakage preventing member is provided with a positioning protrusion that is fitted to the positioning portion.

4. An image forming apparatus according to claim 3, wherein the developing member is movable between a position opposing the image bearing body and a position retracted from the image bearing body, wherein with the developer leakage preventing member being fitted to the apparatus main body, the developing member is set immovable.

5. An image forming apparatus according to claim 4, wherein under the state where the developer leakage preventing member is fitted to the apparatus main body, the developer leakage preventing member and the developing member are abutted against each other.

6. An image forming apparatus according to claim 3, wherein a fitting path of the developer leakage preventing member and a fitting path of the image forming unit are set different from each other.

7. An image forming apparatus according to claim 1, wherein the developer leakage preventing member is provided with a seal member in an area opposing the developing member, wherein with the developer leakage preventing member being fitted to the apparatus main body, the seal member is not abutted against a developing roll of the developing member but is abutted against a housing of the developing member.

8. An image forming apparatus according to claim 7, wherein the developing member is provided with a guide rail that guides the developer leakage preventing member, wherein the developer leakage preventing member is guided by the guide rail at a time of fitting, and the seal member is abutted against the housing of the developing member at a position at which the fitting is completed.

9. An image forming apparatus according to claim 1, wherein in addition to the prevention of the leakage of the developer, the developer leakage preventing member achieves prevention of vibrations of the developing member.

10. An image forming apparatus according to claim 1, comprising:

a plurality of developing members, wherein leakage of developers from the plurality of developing members is prevented with the single developer leakage preventing member.

11. An image forming apparatus according to claim 1, wherein with the developer leakage preventing member being fitted to the apparatus main body, the image forming apparatus is set inoperable.

12. An image forming apparatus according to claim 11, wherein in order to set the image forming apparatus inoperable under the state where the developer leakage preventing member is fitted to the apparatus main body, a storage medium is used which is provided for an image forming unit and stores identification information with reference to which the image forming unit is identified on an apparatus main body side.

13. An image forming apparatus according to claim 11, wherein in order to set the image forming apparatus inoperable under the state where the developer leakage preventing member is fitted to the apparatus main body, an operation prohibition displaying tag is used which is provided for the developer leakage preventing member and is exhibited outside the apparatus main body.

14. An image forming apparatus according to claim 1, wherein an image forming unit itself is used as the developer leakage preventing member, and the image forming apparatus is shipped with the developing member being set at a developing position opposing an image bearing body of the image forming unit.

15. An image forming apparatus that is shipped with a developing member being fitted to an apparatus main body, comprising:

a developer leakage preventing member that prevents leakage of a developer from the developing member, wherein the developer leakage preventing member is fitted to the apparatus main body in place of an image bearing body opposing the developing member and is fixed to the apparatus main body using a member that is also used to fix the image bearing body thereto.

16. An image forming apparatus according to claim 15, wherein the image bearing body is fixed to the apparatus main body through supporting axes protrudingly formed in both end portions of the image bearing body.

17. An image forming apparatus according to claim 16, wherein the developer leakage preventing member is fixed to the apparatus main body through protrusions protrudingly formed in both end portions of the developer leakage preventing member so as to respectively correspond to the supporting axes of the image bearing body.

18. A developer leakage preventing member that is fitted to an image forming apparatus shipped with a developing member being attached to an apparatus main body so as to oppose an intermediate transfer body, and which prevents leakage of a developer from the developing member, the developer leakage preventing member comprising:

a first surface having a shape with which an opening portion of the developing member is closed; and a second surface having a shape that approximately resembles a part of a shape of the intermediate transfer body.

19. A developer leakage preventing member according to claim 18, further comprising seal members that prevent leakage of the developer from both sides of the developing member.

20. A developer leakage preventing member according to claim 18, wherein the first surface of the developer leakage preventing member is formed to have a curved surface that is larger than a developing roll.

21. A developer leakage preventing member according to claim 18, which is formed in a vertical rectangular parallelepiped shape whose external shape resembles an external shape of an image bearing body unit and whose surface on an intermediate transfer body side is fully opened.

22. A developer leakage preventing member according to claim 18, which is constructed so as to abut against a housing of the developing member under a state where the developing member is retracted.

23. A developer leakage preventing member according to claim 18, wherein a side surface of the developer leakage preventing member on an intermediate transfer body side is fully opened and a portion of the developer leakage preventing member corresponding to a surface of the intermediate transfer body is cut away in a circular arc shape.

24. A developer leakage preventing member according to claim 18, wherein protrusions respectively corresponding to supporting axes of an image bearing body are protrudingly formed on a front-side end surface and a rear-side end surface of the developer leakage preventing member.

25. A developer leakage preventing member according to claim 18, which is fitted to the apparatus main body in place of an image bearing body unit in completely the same manner as the image bearing body unit at the time of shipment of the image forming apparatus.

26. A developer leakage preventing member according to claim 18, which is fitted to the apparatus main body so as to cover an opening portion side of the retracted developing member without generating gaps.

27. A method for shipping/transporting an image forming apparatus with a developing member being fitted to an apparatus main body, comprising:

at the time of shipment, retracting a unit including the developing member to a rearward and fitting a developer leakage preventing member in place of an image bearing body unit opposing the developing member; and after transportation, detaching the developer leakage preventing member and fitting the image bearing body unit.

28. A method for shipping/transporting an image forming apparatus according to claim 27, wherein attachment and detachment of the developer leakage preventing member is performed in completely the same manner as attachment and detachment of the image bearing body unit.

* * * * *